US010000980B2

(12) United States Patent
Bjørnenak

(10) Patent No.: US 10,000,980 B2
(45) Date of Patent: Jun. 19, 2018

(54) CONVEYOR APPARATUS

(71) Applicant: Stimline AS, Kristiansand (NO)

(72) Inventor: Mads Bjørnenak, Kristiansand (NO)

(73) Assignee: Stimline AS, Kristiansand (NO)

( * ) Notice: Subject to any disclaimer, the term of this patent is extended or adjusted under 35 U.S.C. 154(b) by 138 days.

(21) Appl. No.: 15/111,877

(22) PCT Filed: Jan. 23, 2015

(86) PCT No.: PCT/EP2015/051320
§ 371 (c)(1),
(2) Date: Jul. 15, 2016

(87) PCT Pub. No.: WO2015/113901
PCT Pub. Date: Aug. 6, 2015

(65) Prior Publication Data

US 2016/0333649 A1 Nov. 17, 2016

(30) Foreign Application Priority Data

Jan. 28, 2014 (NO) ..... 20140094

(51) Int. Cl.
*E21B 19/22* (2006.01)
*E21B 19/08* (2006.01)
*E21B 17/20* (2006.01)

(52) U.S. Cl.
CPC ..... *E21B 19/08* (2013.01); *E21B 17/20* (2013.01); *E21B 19/22* (2013.01)

(58) Field of Classification Search
CPC ..... E21B 19/22
See application file for complete search history.

(56) References Cited

U.S. PATENT DOCUMENTS 3,056,535 A 10/1962 Baugh
3,285,485 A 11/1966 Slator
(Continued)

FOREIGN PATENT DOCUMENTS

EP 0507280 A1 10/1992
EP 1036747 A2 9/2000
(Continued)

OTHER PUBLICATIONS

Hydra Rig; "Hydra Rig Coiled Tubing Products"; http://web.archive.org/web/20031213202100/http://www.hydrarig.com/Products/CT.htm; Dec. 13, 2003; 1 page.
(Continued)

*Primary Examiner* — Shane Bomar
(74) *Attorney, Agent, or Firm* — Winstead PC

(57) ABSTRACT

A conveyor apparatus (2), so-called injector head, to enable feeding of e.g. continuous tubing (7) or coiled tubing through the conveyor apparatus (2) to or from a wellhead and a well below and related to use of well tools. There is provided an apparatus frame (21) within an apparatus cage (5), and a pair of oppositely located, cooperatively movable, segmented continuous belts (28; 29) installed in the frame, each belt (28; 29) comprising a plurality of interconnected) gripper shoe carriers (30) carried and movable by means of a pair of continuous belt drive chains (31; 32), and a gripper shoe (38; 52) cooperative with each carrier (30) to positively engage the tubing. The frame (21) at its lower end (21') is tiltably connected to the cage (5) so as to cause said cage (5) and frame (21) to be mutually tiltable in a tilting plane about a single tilting axis (58) which passes through a stuffing box (22') located at a lower region of the cage (5). The frame (21) has at a top region thereof a pair of rollers (24') between which the tubing (7) passes, a force imposed on one or the
(Continued)

other of the rollers (24') causing tilting of the frame (21) relative to the cage (5).

12 Claims, 24 Drawing Sheets

(56) References Cited

U.S. PATENT DOCUMENTS

| | | | | |
|---|---|---|---|---|
| 4,013,205 | A | 3/1977 | Fabre-Curtat et al. | |
| 5,094,340 | A | 3/1992 | Avakov | |
| 5,188,174 | A | 2/1993 | Anderson, Jr. | |
| 5,309,990 | A | 5/1994 | Lance | |
| 5,918,671 | A | 7/1999 | Bridges et al. | |
| 5,975,203 | A | 11/1999 | Payne et al. | |
| 6,173,769 | B1 | 1/2001 | Goode | |
| 6,209,634 | B1 | 4/2001 | Avakov et al. | |
| 6,216,780 | B1 | 4/2001 | Goode et al. | |
| 7,077,209 | B2 | 7/2006 | McCulloch et al. | |
| 8,191,620 | B2 | 6/2012 | Maschek, Jr. et al. | |
| 9,074,432 | B1 * | 7/2015 | Crosby | E21B 33/068 |
| 2001/0040031 | A1 | 11/2001 | Shaaban et al. | |
| 2005/0199400 | A1 | 9/2005 | Moncus et al. | |
| 2006/0081368 | A1 | 4/2006 | Rosine et al. | |
| 2007/0137866 | A1 | 6/2007 | Ravensbergen et al. | |
| 2009/0223677 | A1 * | 9/2009 | Dreelan | E21B 19/09 166/381 |
| 2011/0048694 | A1 | 3/2011 | Maschek, Jr. et al. | |
| 2013/0233571 | A1 | 9/2013 | Goddard | |
| 2013/0333900 | A1 | 12/2013 | McCulloch | |
| 2014/0041853 | A1 | 2/2014 | Dineen | |
| 2014/0305632 | A1 | 10/2014 | Pendleton | |
| 2016/0040488 | A1 * | 2/2016 | Behrens | E21B 19/22 166/77.2 |

FOREIGN PATENT DOCUMENTS

| | | | |
|---|---|---|---|
| GB | 2325948 | A | 12/1998 |
| NO | 20131601 | A | 6/2015 |
| NO | 20131640 | A | 6/2015 |
| WO | WO-2013008046 | A1 | 1/2013 |
| WO | WO-2015113896 | A2 | 8/2015 |
| WO | WO-2015113899 | A2 | 8/2015 |
| WO | WO-2015113905 | A2 | 8/2015 |

OTHER PUBLICATIONS

Hydra Rig; "HR-560 Series Coiled Tubing Injector"; http://web.archive.org/web/20040314144921/http://www.hydrarig.com/PDF/Brochures/CoiledTubing/560 Brochure.pdf; Dec. 13, 2003; 2 pages.

Hydra Rig; "HR 580 Series Coiled Tubing Injector"; http://web.archive.org/web/20050309225708/http://www.hydrarig.com/PDF/Brochures/CoiledTubing/580 Brochure.pdf; Dec. 13, 2003; 2 pages.

Dekker, Derk, "International Search Report," prepared for PCT/EP2015/051320, dated Aug. 3, 2015, five pages.

Dekker, Derk, "International Search Report," prepared for PCT/EP2015/051307, dated Aug. 3, 2015, four pages.

Dekker, Derk, "International Search Report," prepared for PCT/EP2015/051317, dated Aug. 3, 2015, four pages.

Dekker, Derk, "International Search Report," prepared for PCT/EP2015/051346, dated Aug. 3, 2015, four pages.

* cited by examiner

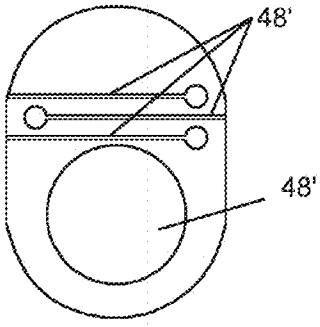
FIG. 12j
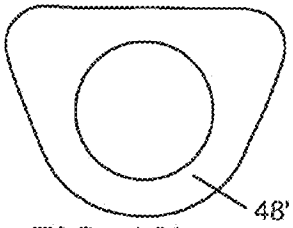
FIG. 12h
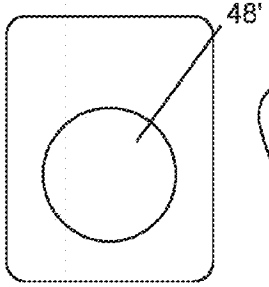
FIG. 12f
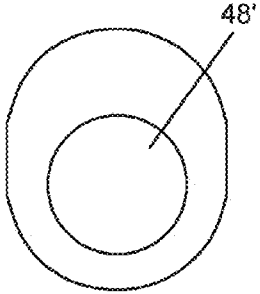
FIG. 12d
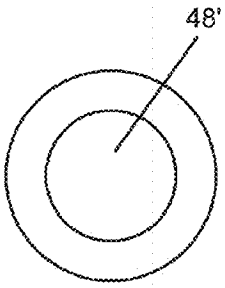
FIG. 12b
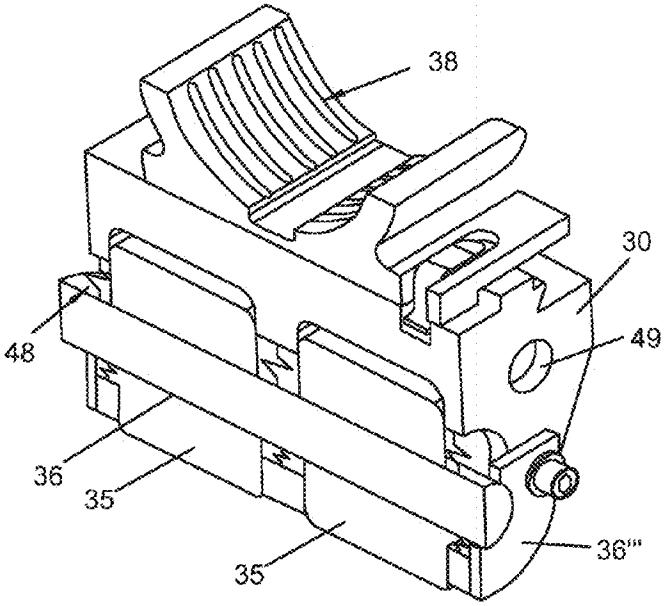
FIG. 12l
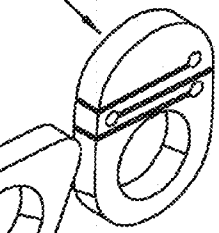
FIG. 12k
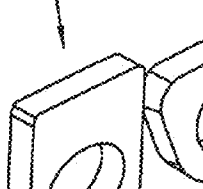
FIG. 12i
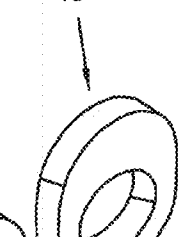
FIG. 12g
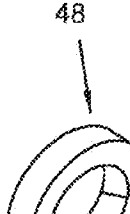
FIG. 12e
FIG. 12c

CONVEYOR APPARATUS

FIELD OF THE INVENTION

The present invention relates to a conveyor apparatus, to enable feeding of continuous elongate device (CED), such as e.g. coiled tubing, rod, wire or wireline down through the conveyor apparatus, to enable insertion of tools through the wellhead and into a well below, or up through the conveyor apparatus by pulling action enabling retrieval of such tools from the wellhead and the well below.

Such a conveyor apparatus is frequently called an "injector head" in this particular field of use.

The wellhead is primarily meant for oil and natural gas exploration and production operations.

Particularly, the present invention relates to a technology for inserting and retrieval of a drill tool being supported by continuous elongate device (CED), in a non-limiting example being e.g. a continuous tubing, suitably coiled tubing running through the lubricator string sections.

In the description and claims, the general term CED, i.e. Continuous Elongate Device, will be used, implying that the CED may be interpreted as being a continuous tubing (e.g. coiled tubing), continuous rod or interconnected rod sections, continuous wire or continuous wireline. In case of rods or rod sections, they could e.g. be massive rods of metal, metal alloys, carbon material, fiber reinforced plastic material.

However, in the discussion of the prior art and in the detailed description it will mostly be referred to the use of continuous tubing as a practical example of CED.

More particularly, the present invention relates to a conveyor apparatus according to the preamble of claim 1.

TECHNICAL BACKGROUND OF THE INVENTION

Use of CED's, such as e.g. coiled tubing, sourced from a hydraulically operated reel is known in oil and natural gas exploration and production operations. These tubings, generally refer to metal pipes, e.g. made from steel, with diameter ranging between 1 inch and 4 inches (2.54-10.12 centimeters), or suitably within the range 1.5 to 3.5 inches (3.81-8.89 centimeters). Such tubing may typically have a wall thickness of 5-15% of the tubing diameter, although a different wall thickness range may applied dependent on the use of the tubing. It is also known, that coiled tubing can perform many different oil well operations, and these include use in interventions in oil and gas wells, and use as production tubing in gas wells as well.

Application of such coiled tubing in oil and gas operations involves deploying the tubing as support for drill tools for inserting those tools into boreholes or for retrieving those tools from boreholes. Such tools can be packers, valves, sleeves, sensors, plugs, gauges and so on, which have to be run into and retrieved from the boreholes. These tools may find use for servicing the well.

The operations as stated in the preceding paragraph are done through lubricator string sections and those sections serve as a sluice for undertaking such operations.

How a lubricator string functions for insertion of tools into the well and for retrieval of the same therefrom, are all common knowledge in the art and will not be elaborated on any further.

How to handle a tubular piping system is e.g. described in Norwegian Patent Application Nr. 20131601, filed on 3. Dec. 2013 and entitled PIPE HANDLER, the disclosure of which is hereby incorporated by this text reference.

In the above context, telescopic injector masts are also known which extend from a base up to a substantial height and supports a coiled tubing conveyor apparatus at its top end and a lubricator string suspended from the coiled tubing conveyor apparatus. Upon insertion into the wellhead, prior thereto coiled tubing is stabbed through the coiled tubing conveyor apparatus, and thereafter conveyed through the lubricator string, which is located just above the borehole. The purpose is to insert tools into the borehole as stated before. The pulling operation of coiled tubing takes place in just the opposite direction of retrieving the tools from the borehole.

As stated before, injector masts for ensuring lifting of tubing conveyor apparatus (injector heads) to undertake the operation as stated in the preceding paragraph are already known. For example, U.S. Pat. No. 7,077,209 teaches a telescopic mast having two arms, which can telescopically rise for supporting a tubing gripper conveyor apparatus at a height and positioning it above the wellhead. The mast is pivotally mounted to a vehicle.

The above document and likewise prior art known in the art does not have any teachings for rapid, accurate and safe assembling of lubricator strings below the injector head and aligning these above the well head, thereby ensuring smooth passage of the coiled tubing.

Furthermore, no teachings exist in prior art on how to precisely receive the coiled tubing from any direction and to pass it through the coiled tubing conveyor head, and simultaneously ensuring that the coiled tubing conveyor head is appropriately positioned above the well head.

A technology to meet the need of providing said teachings, which are lacking in prior art, and other associated needs, is described in Norwegian Patent Application Nr. 20131640 filed on 10 Dec. 2013 and entitled HANDLING SYSTEM, the disclosure of which is hereby incorporated by this text reference, the handling system described therein being equipped with a telescopic mast, mounting a tubing conveyor apparatus (or an injector head) at its top end, which mast can swivel about a vertical axis for correct injection or pulling out of the continuous tube from any direction, through the tubing conveyor apparatus and through lubricator strings. The mast also has a handling device for efficiently and rapidly assembling and disassembling lubricator strings on and from the top of the wellhead and for proper positioning and alignment of the strings beneath the tube conveyor head.

In the context of the prior art described above it has been recognized that gripping elements of the tubing conveyor apparatus should be related to a movable carrier and a gripper shoe which is removably attached to such carrier.

The disclosure of U.S. Pat. No. 6,173,769-B1 describes a coiled tubing conveyor apparatus exhibiting inter alia a pair of continuous, segmented drive belts, each belt with a plurality of carriers carried by a pair of drive chains, each carrier having front and back sides, and means for removably attaching a tubing gripper shoe to a front side of the carrier, an elastomeric pad with high spring rate being sandwiched between a gripper shoe base and the carrier to allow the gripper shoe to resiliently "float" on the carrier. The purpose of the elastomeric pad is to allow the gripper shoe to automatically make small adjustments in its alignment with coiled tubing as it engages the tubing, thus providing a more even distribution of gripping forces across the shoe. The elastomeric pad also accommodates manufacturing tolerances that result in slight variations in the distances between an elongate counter-force member, typically known as a "skate" in the art, on which rollers on the carriers ride, and the centerline of the tubing to be gripped. Preferably, only gripper shoes are used that have fixed shapes conforming to a normal shape of the tube or pipe, and that surround substantially half of the circumference of the tubing. As an outset, fixed shaped shoes cause the tubing to retain its normal shape when conveyed through the conveyor head and enhance the gripping ability, provided that e.g. the tubing diameter has not changed substantially.

EP 0507280 shows an injector having a load cell. The injector head is attached to the load cell on one side and a hinge on the other side. Consequently, the injector head will tilt slightly about the hinge and inflict a force on the load cell. The tilting movement required to sense the load is very small. There is no indication that the hinge is adapted to allow for any significant degree of tiling beyond what is required to trigger the load cell.

If the hinge had allowed for larger tilting, such as beyond 1°, this would result in a sever pull and push force inflicted on the coiled tubing over the short stretch between the lowermost gripper and the lubricator. This is not desirable.

US 2006/081368 shows an injector where each half of the injector head is hingedly attached to a frame. Thereby the halves can be swung outward from one another so that the coiled tubing can be thread through the injector head with ease. If the halves are allowed to tilt about these hinges when the injector is operating, the grippers will be forced to glide relative to the coiled tubing, which in turn results in great wear of the coiled tubing.

U.S. Pat. No. 6,209,634 shows an injector similar to US 2006/081368, having the same features.

OBJECTS OF THE INVENTION

According to an aspect of the present invention it has been observed that the counter-force members, due to strong forces acting thereon have a tendency to become "wavy" along their length, which has an adverse effect on the tubing to be gripped and conveyed through the conveyor apparatus, because the gripping forces from the gripper shoes become uneven through the apparatus, which could trigger related wavy configuration of the tubing in its longitudinal direction. The reason is that the forces, which act on the counter-force members caused by inter-space setting means substantially, only act transversely of an elongate part of the counter-force member. This will introduce along its length locations with high stresses and other locations having lower stresses causes by bending or depressions the member. There are currently no solutions to overcome this operational drawback.

It is the principal object of the present invention to provide a CED conveyor apparatus to enable a continuous elongate device to be injected into or pulled out from a borehole wellhead via an array of lubricator strings aligned below the apparatus (injector head) and above the wellhead for passage of the continuous elongate device therethrough, and in addition ensuring that the conveyor head is appropriately positioned above the well head.

More specifically, the invention is in general intended to provide remedies in order to substantially overcome the mentioned challenges which are well known from the current prior art.

SUMMARY OF THE INVENTION

The conveyor apparatus mentioned in the introduction further comprises:

an apparatus frame, a pair of oppositely located, co-operatively movable, segmented continuous belts installed in the frame, each belt comprising a plurality of interconnected device gripper shoe carriers carried and movable by means of a pair of continuous belt drive chains running over respective pairs of chain drive sprockets, wherein a rear side of the carrier has at least one roller configured to roll about a shaft attached to the carrier against an elongate counter-force member, a so-called skate, associated with the frame and extending between said drive sprockets, wherein a device gripper shoe is co-operative with each carrier to positively engage the continuous elongate device, and wherein a pair of said counter-force members being adapted to interact with a respective belt.

According to the invention, the conveyor apparatus is characterized in that the counter-force member has a) a elongate part, and b) along the length of the elongate part a plurality of pairs of substantially V shaped elements, the elements of each pair extending with their V-legs laterally from oppositely located side edges of the elongate part towards an apex of the V-shaped element, that an axis of one leg of a V-element of one pair of elements, at one side edge of the elongate part, is aligned with a leg of a V-element of another and adjacent pair of elements, at the other side edge of the elongate part, and that the V-elements are integral with the elongate part and co-planar therewith.

According to an embodiment of the conveyor apparatus, the elongate part and each of said elements have substantially the same thickness.

According to a further embodiment of the conveyor apparatus, at least one pair of the V-shaped elements have legs, which are wider than the legs of other pairs of V-shaped elements. Suitably, said at least one pair of V-shaped elements is located at longitudinal mid-region side of the elongate part.

In an alternative embodiment of the conveyor apparatus, at least two pairs of the V-shaped elements have legs, which are wider than the legs of other pairs of V-shaped elements. Suitably, one pair of the at least two pairs of V-shaped elements is located upstream of longitudinal mid-region sides of the elongate part, and another pair of the at least two pairs of V-shaped elements is located downstream of longitudinal mid-region sides of the elongate part.

According to an additional embodiment of the conveyor apparatus, means are provided to adjust mutual spacing of the pair of counter-force members interact with the V-apexes of said elements.

According to a another embodiment of the conveyor apparatus, the plurality of pairs of substantially V shaped elements can be considered as substantially triangular slabs protruding laterally and integrally from either longitudinal side of the elongate part of the counter-force member, a hole being present in the slab adjacent the elongate part. Suitably, the shape of the hole is substantially triangular, circular or oval.

BRIEF DESCRIPTION OF THE DRAWINGS

Having described the main features of the invention above, a more detailed and non-limiting description of non-limiting embodiments of the conveyor apparatus according to the invention and aspects thereof is given below, with reference to the attached drawings.

FIG. 10*a* is a perspective front view from the another end of the novel gripper shoe carrier with the gripper shoe not present.

FIGS. 12*b*-12*k* illustrate variants of resilient members to provide resiliency of a gripper shoe and its carrier, and FIG. 12*l* is symbolic of other resilient members.

DETAILED DESCRIPTION OF THE INVENTION

Figure 1:
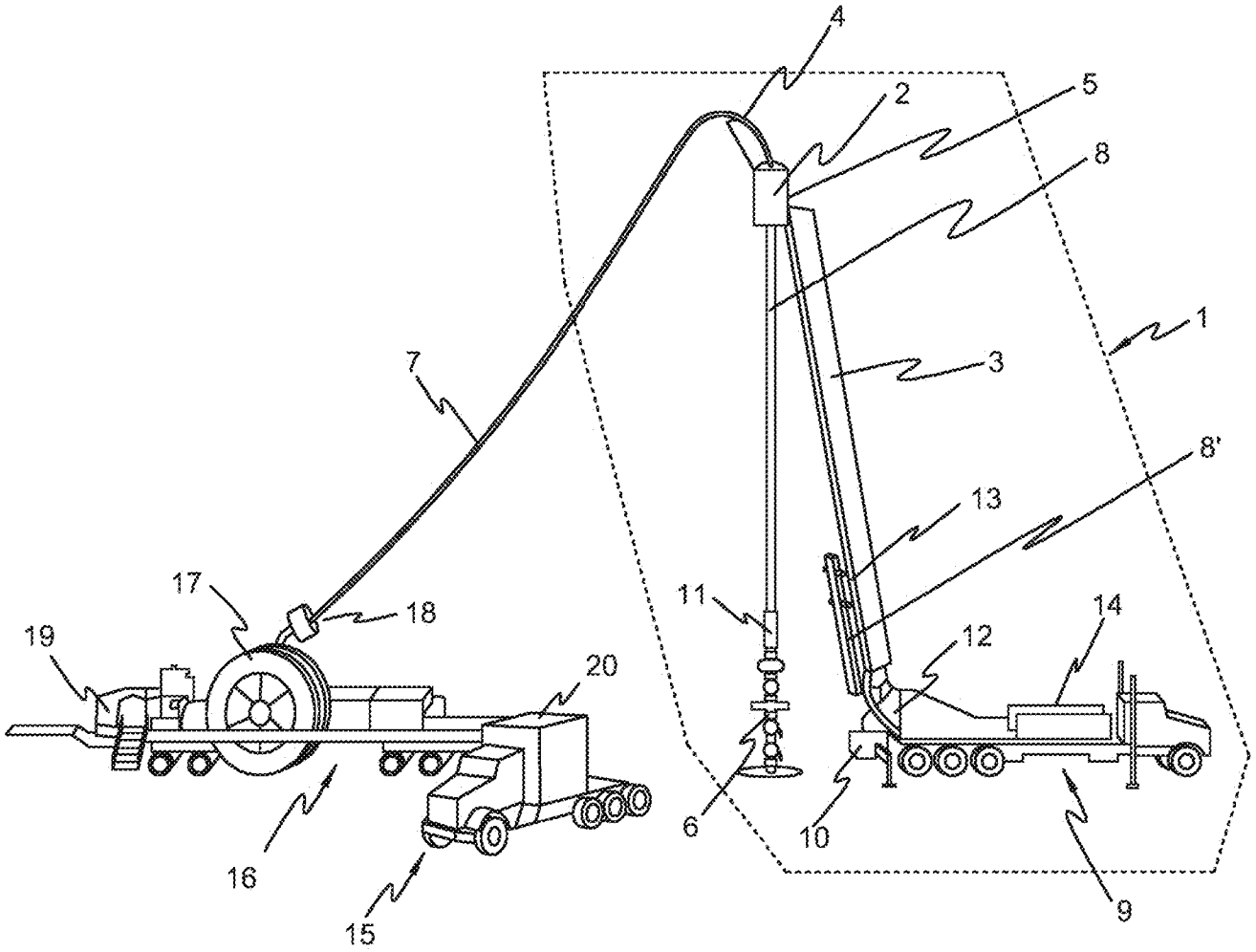
FIG. 1 is an overview of a handling system in which a preferred embodiment of the conveyor apparatus of the present invention is used.
Figure 2:
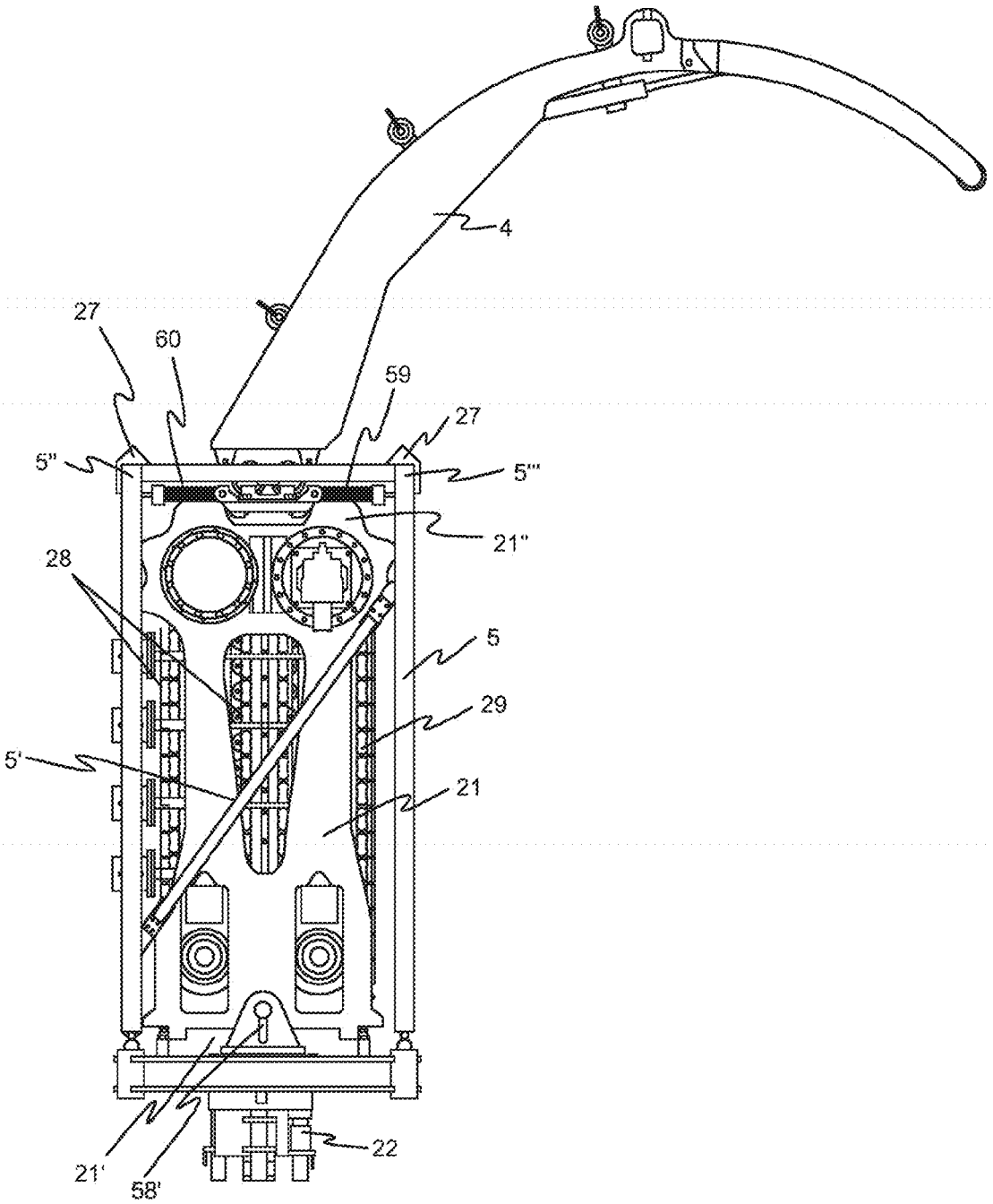
FIG. 2 is side view from one side of the apparatus, according to the invention with an associated tubing guide arch.
Figure 3:
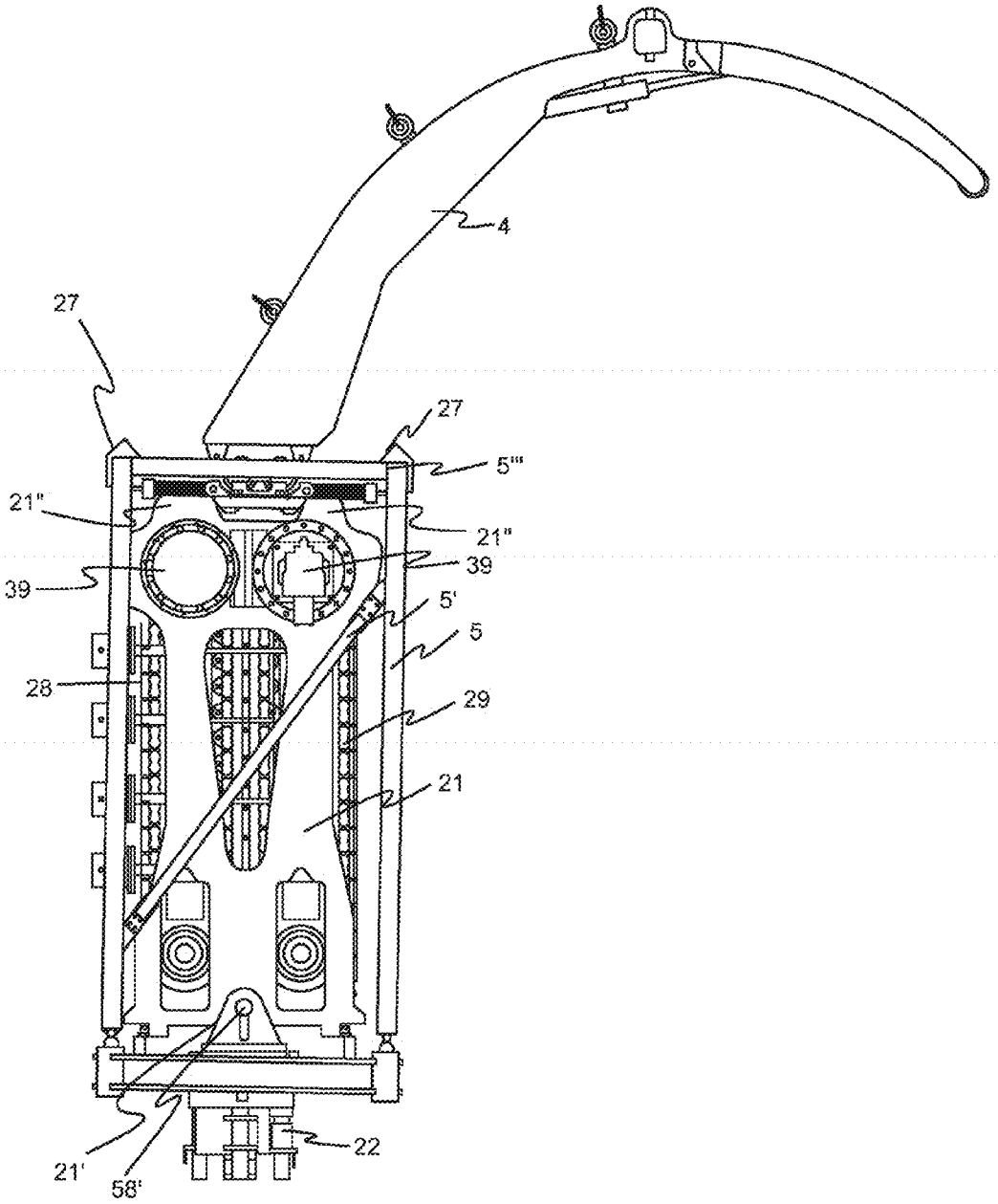
FIG. 3 is the side view of FIG. 2 with mutual position of apparatus frame and apparatus cage slightly changed.

The following describes preferred embodiments of the conveyor apparatus of the present invention and which is exemplary for the sake of understanding the invention and non-limiting.

In the present context, the term "injector head" is to be construed as being synonymous with the term conveyor apparatus as defined in the claims.

Further, the term "counter-force member" is synonymous with the term "skate" frequently used in the art.

All throughout the specification including the claims, the words "CED", continuous elongate device", "handling system", "handling device", "continuous tubing", "coiled tubing", "borehole", "wellhead", "lubricator strings", "bearing", "BOP", "injector head", "injector mast", "tool strings/sections" are to be interpreted in the broadest sense of the respective terms and includes all similar items in the field, known by other terms, as may be clear to persons skilled in the art.

Restriction/limitation, if any, referred to in the specification, is solely by way of example and understanding the present invention. More specifically, hereinafter, the term "coiled tubing" has been referred to for the sake of convenient understanding of the invention. It should be understood that "coiled tubing" also includes other similar continuous tubing as may be known to persons skilled in the art of the present invention. Further, it will be appreciated by the expert in the art that the invention is also applicable to other continuous elongate devices (CED's), such as rods, wires or wirelines.

Although the conveyor apparatus is, in a currently preferred mode of operation, primarily to be used for operation with coiled tubing, the use of the conveyor apparatus in conjunction with other CED's lies within the scope of the invention.

It should also be understood that the orientation of some the apparatus components may exhibit configurations other than those shown in the drawings, without deviating from the principle of the invention, and such different configurations which to not affect the overall operation of the apparatus are to be construed as merely technical equivalents within the scope of the present invention.

FIG. 1 is a view of the basic layout of a handling system 1 in which the conveyor apparatus 2 or injector head 2 of the present invention is present. The handling system 1 comprises an injector carrying mast 3, which is telescopic. The injector mast 3 and a tubing guide arch 4 are operatively linked to a supporting cage 5 of the apparatus 2 (the cage 5 is also shown on FIGS. 2-6*a*) at a top region of the mast 3. This support cage 5 can be moved, e.g. rotated, to ensure alignment of the injector head 2 above a wellhead 6 and also for ensuring smooth feeding of coiled tubing 7 through a lubricator string 8. Movement of the cage 5 can be assisted by hydraulic, pneumatic or electrical drive means.

Apart from being telescopically adjustable, the mast 3 can also be caused to swivel. The mast 3 is supported from below on a mast truck 9. The truck 9, at its rear end has a carrier 10 for parking a BOP (Blowout Preventer) unit 11, when this unit is not in use. The rear portion of the injector mast truck 9 also has a rigging winch 12 and a sheave (not shown) for stabbing/pulling coiled tubing 7 through the conveyor apparatus/injector head 2 when it is "empty", i.e. not yet fully engaging the tubing 7 over a full conveying length of the apparatus 2. The guide arch 4 facilitates this stabbing/pulling operation of coiled tubing 7 through the injector head 2, an operation where the aid from the winch 12 is highly required in view of a substantial drag force action on the tubing in the opposite direction of the pulling/stabbing.

It should be also clear from FIG. 1 that a rear face of the mast 3 is adjacent the injector head 2. This rear face is suitably equipped with a handling device 13 for the lubricator strings 8. The handling device 13 allows accurate, rapid and safe assembly and disassembly of the lubricator string sections 8' on and from the top of the wellhead 6.

FIG. 1 also shows a hydraulic power unit 14 located along the chassis of the truck 9. The operations are mostly hydraulically powered and this unit supplies hydraulic pressurized fluid to numerous hydraulic motors (not shown on FIG. 1) used in the handling system. In addition, FIG. 1 shows a reel truck 15 and the reel trailer 16 which are well known to persons skilled in the art. The coiled tubing 7 is supplied from a reel 17 located on the trailer 16. The release from or winding of tubing onto the reel 17 is assisted and facilitated by a tubing tensioner 18 which is hydraulically powered by an hydraulic unit 19 at the rear portion of the reel trailer 16. The central portion of the reel truck 15 has a control room 20.

The mast 3 and the reel 17 (drop-in type) can also rest on other platforms, such as fixed structures, as known to persons skilled in the art.

The mast 3 is of telescoping type or a combination of folding plus telescoping type. The mast has one telescope section for simplicity, however additional sections are possible if required. The mast cross section is suitably of self-centering type.

Expected maximum height from ground to the cage 5 is approximately 20 meters. The mast 3 extends from its base on the truck 9 and lifts the injector head 2 supported by the cage 5. The injector head 2 includes the carrying cage 5 and the tubing guide arch 4 is mounted onto the top of that cage 5, and the cage 5 is attached to the top of the mast 3.

The cage 5 can be tilted hydraulically relative to the mast 3 to enable the cage 5 to be positioned vertically as the mast 1 is angled, to thereby align the injector head 2 and its cage 5 with a centre line of the well head 6 and the well below (not shown).

The guide arch 4 can be rotated relative to the cage 5 from a first operational position through 180° to a second operational position. However, the cage 5 can be rotated relative to the mast 3 to accept coiled tubing 7 (or CED) from the reel 17 from any desired direction around the mast 3, depending upon the location of the reel 17.

The various essential aspects of the conveyor apparatus will now be described in more detail with reference to FIGS. 2-20.

As described above the conveyor apparatus, a so-called "injector head" 2, enables injection of continuous tubing, e.g. coiled tubing 7, down through the conveyor apparatus 2 and then through lubricator strings 8 located between the apparatus 2 and the wellhead 6, suitably via a BOP (blowout-preventer) 11 to enable insertion of tools (not shown) into the wellhead 6 and further into a well below (not shown) on the drawings), or up through the conveyor apparatus 2 by pulling action enabling retrieval of the tool from the wellhead and the well below.

As mentioned above, the conveyor apparatus 2 has an apparatus cage 5. Further, an apparatus frame 21 is located within the cage 5 as seen on FIGS. 2-4 and 6. At a lower end of the cage 5, there is located a connector 22 to enable attachment of the cage 5 onto an uppermost end of the lubricator string 8. The cage 5 is suitably provided with open sides to enable more convenient monitoring of the operation of the entire conveyor apparatus 2. Stays 5' are provided to provide sufficient rigidity of the cage 5.

Figure 4A:
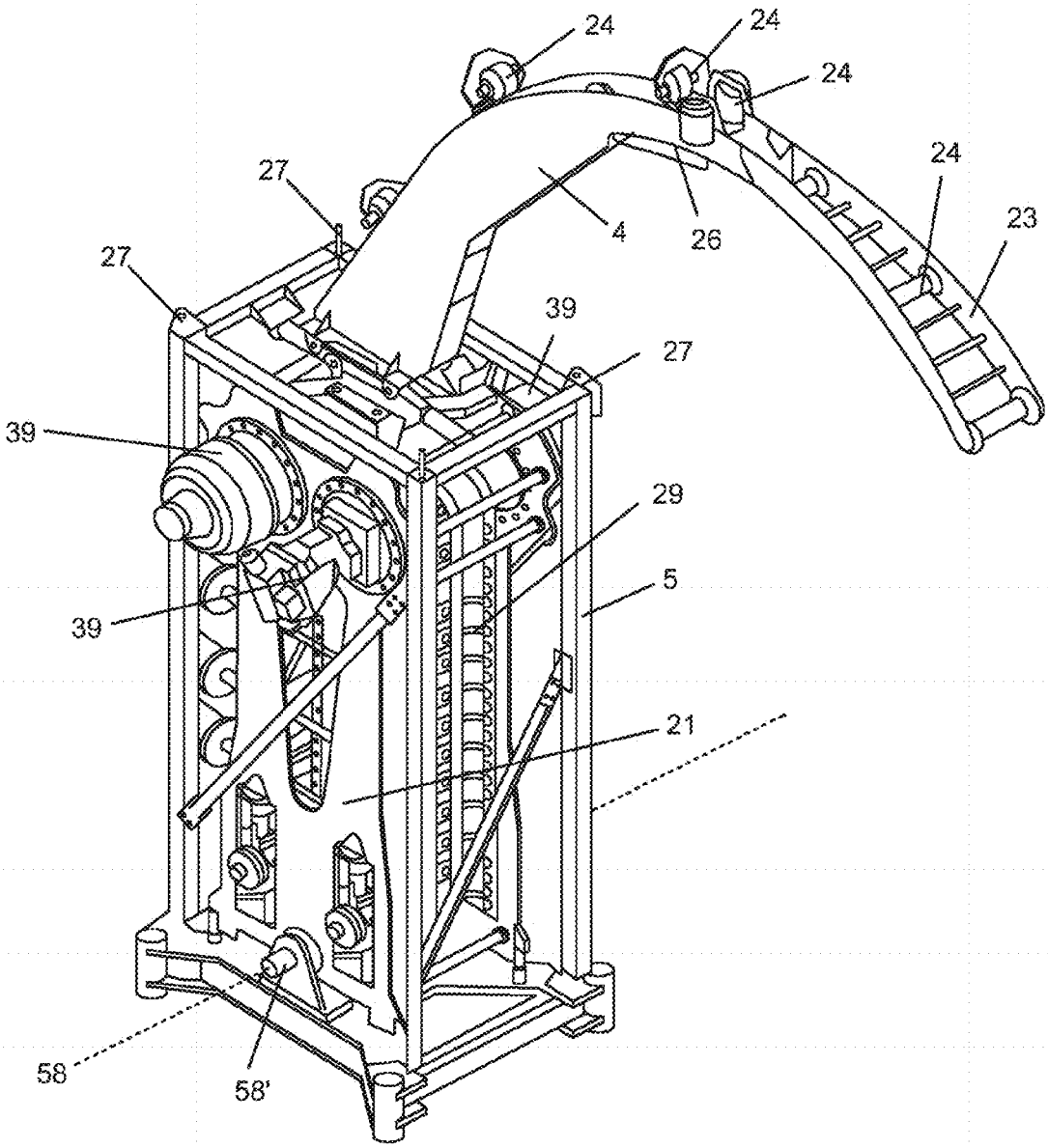
FIG. 4*a* is a perspective view from above and said one side of the apparatus and with the associated tubing guide arch.
Figure 4B:
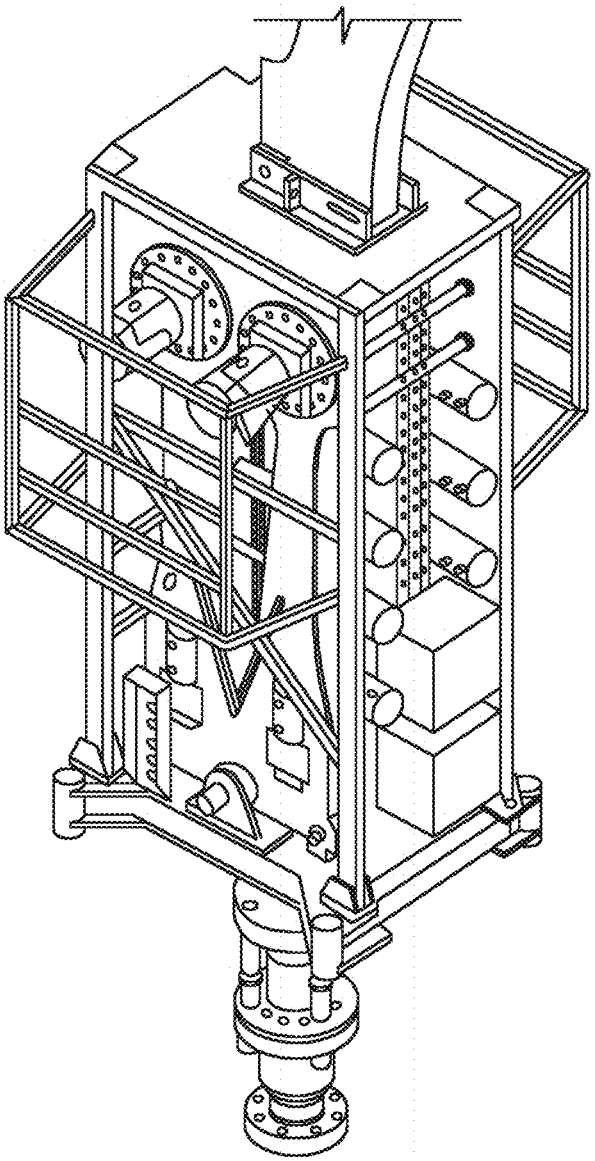
FIG. 4*b* is a perspective view from above and the other side of the apparatus and with the associated tubing guide arch and add-on protective cages.

To the extent that structural elements protrude out from the frame 21 and through the circumference of the cage 5, cage add-on's as shown on FIG. 4*b* can be installed, so as to crash-protect such structural elements.

Figure 5:
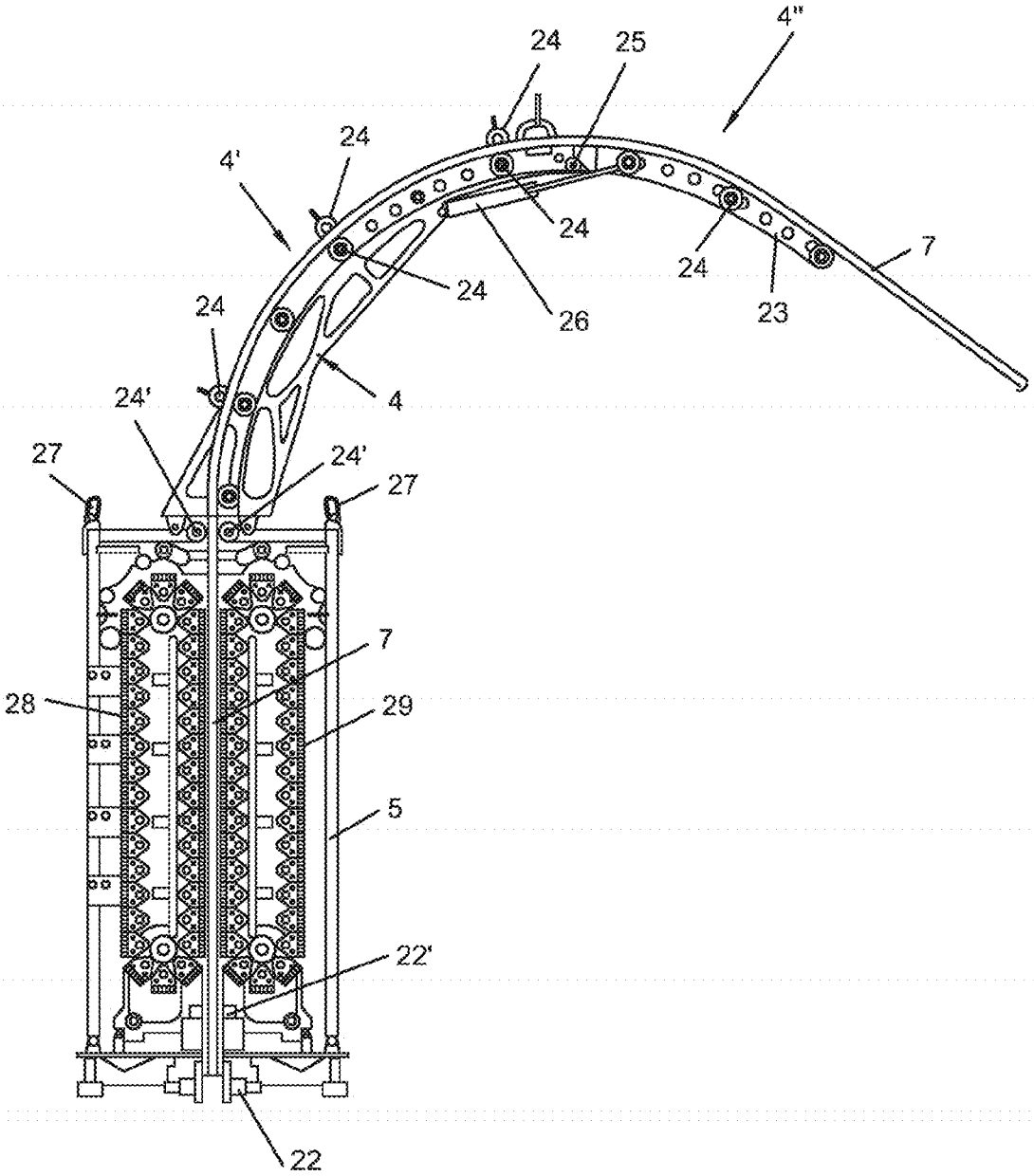
FIG. 5 is a vertical cross-section through the view of FIG. 2.

It is noted from viewing FIGS. 4 and 5 that the tubing guide arch 4 has a curved tubing track 23 with a plurality of guide rollers 24 to enable the tubing 7 to follow the track 23, so as to enter vertically into the conveyor apparatus or injector head 2 in a proper manner, as clearly seen on FIG. 5. For stow-away purposes, the guide arch 4 can be made foldable into e.g. two parts 4' and 4" hinge connected at a hinge connection 25, and kept in respective positions using a controllable ram 26.

Figure 7:
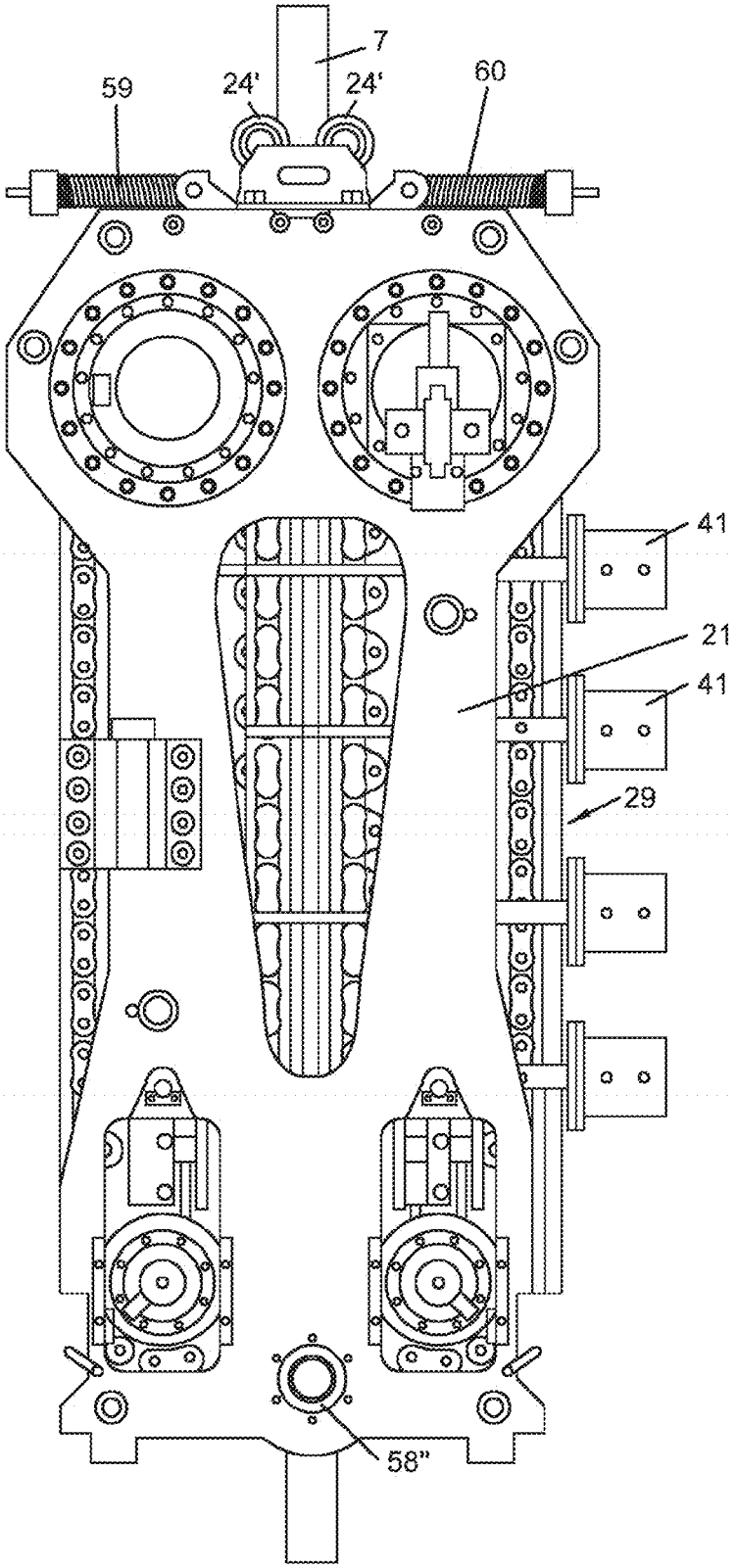
FIG. 7 is an enlarged view of the apparatus from said other side without the apparatus cage.
Figure 8:
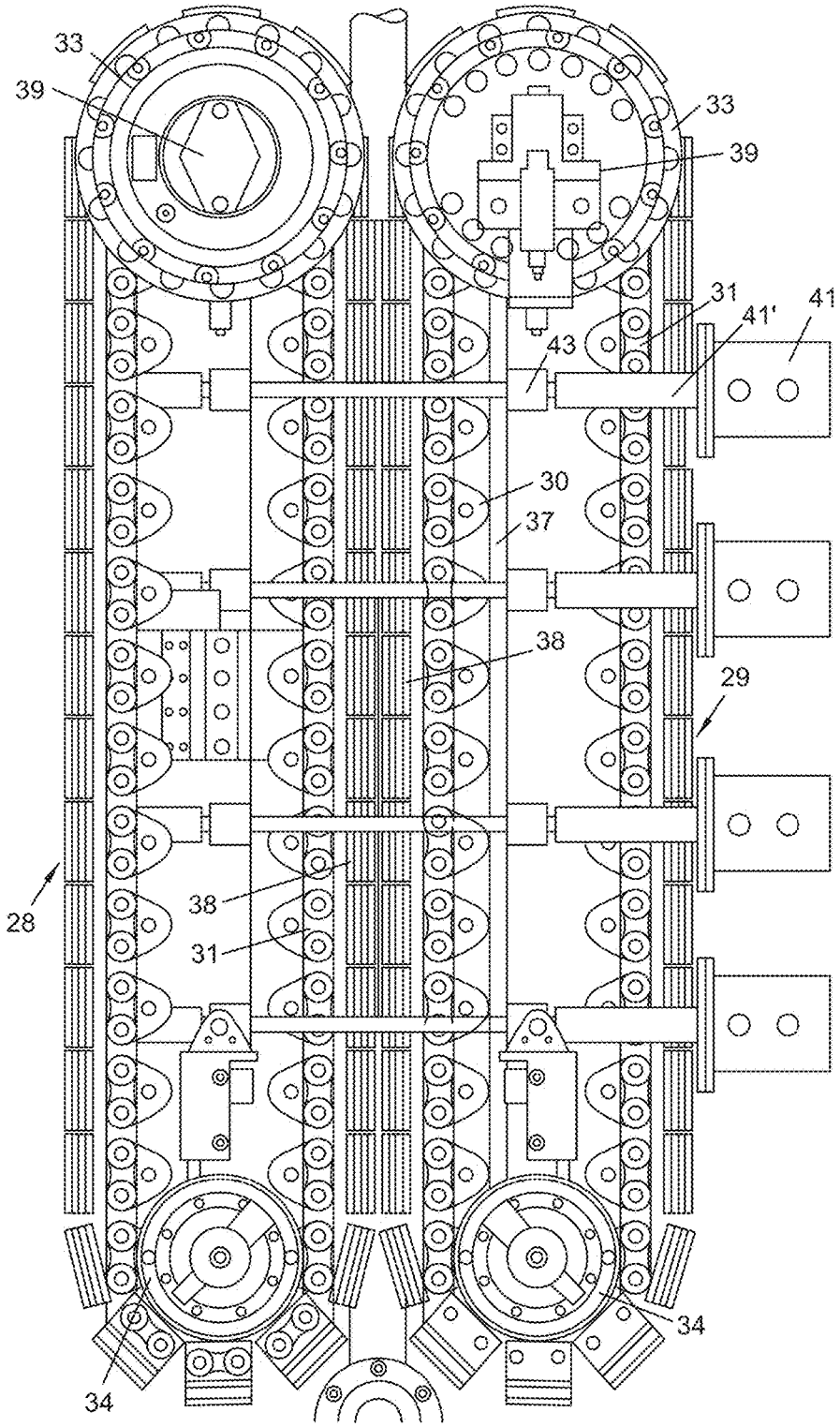
FIG. 8 is an enlarged view of the apparatus from said other side without the apparatus cage and frame shown.
Figure 9:
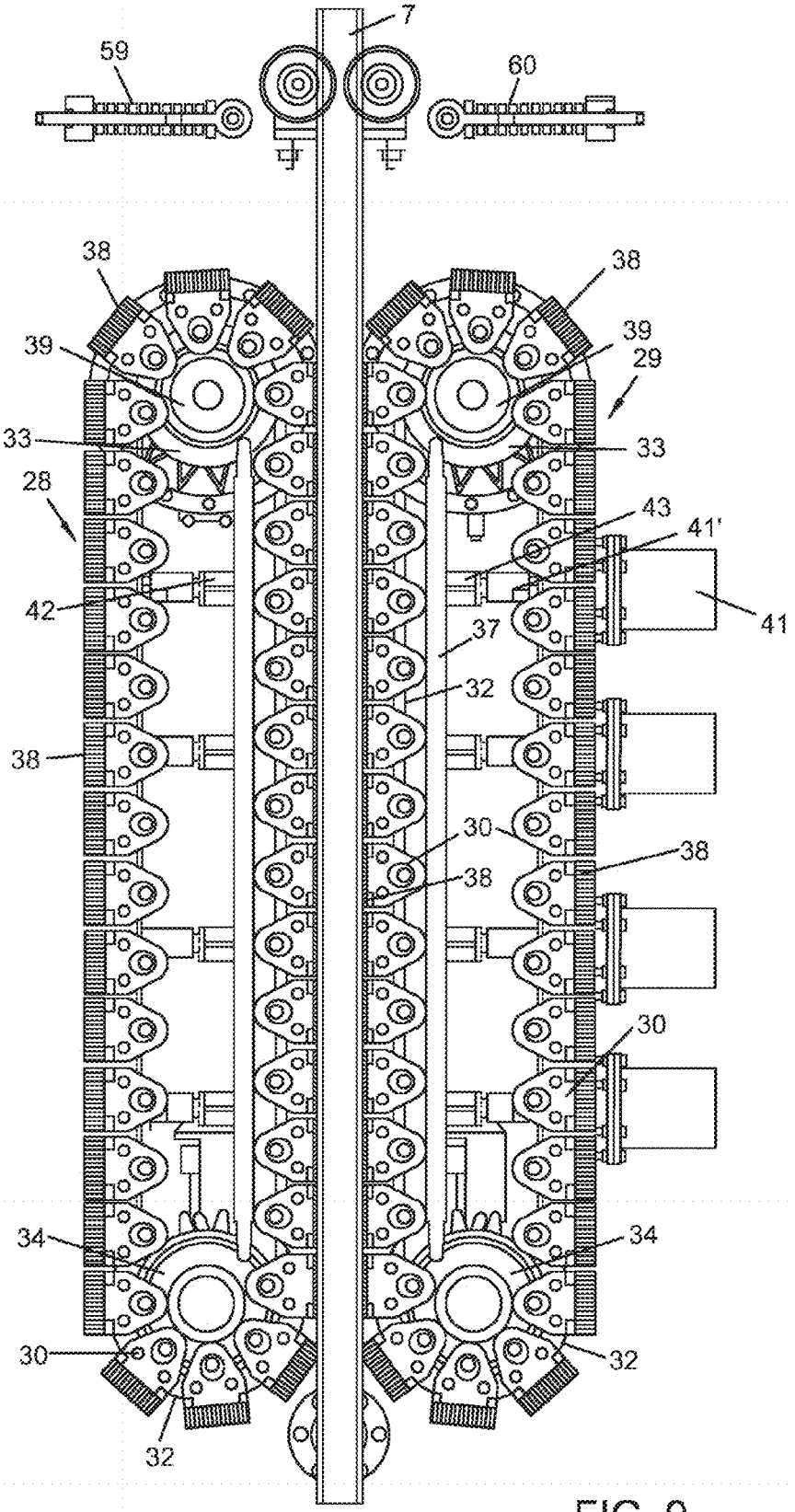
FIG. 9 is a simplified vertical cross-section through the view of FIG. 8.

It is noted from FIGS. 5 and 7 that there are further guide rollers 24' between which the tubing 7 passes. If pressure is exerted on one or the other of these rollers 24', such pressure will cause the frame 21 to tilt relative to the cage 5, optionally against the counter-force of spring 59 or 60.

At the top of the cage 5 there are located a plurality of lifting lugs 27 to enable the cage 5 to be lifted from a crane. The cage 5 is conventionally attached to the mast 3 at a bottom region of the cage.

The conveyor apparatus 2 has a pair of upright, oppositely located, co-operatively movable, segmented, continuous belts 28; 29 installed in the frame 21. Each belt 28; 29 comprises a plurality of interconnected tubing gripper shoe carriers 30 and a pair continuous belt drive chains 31; 32 (see FIGS. 8-13) running over respective pairs of chain drive sprockets 33; 34.

Figure 10A:
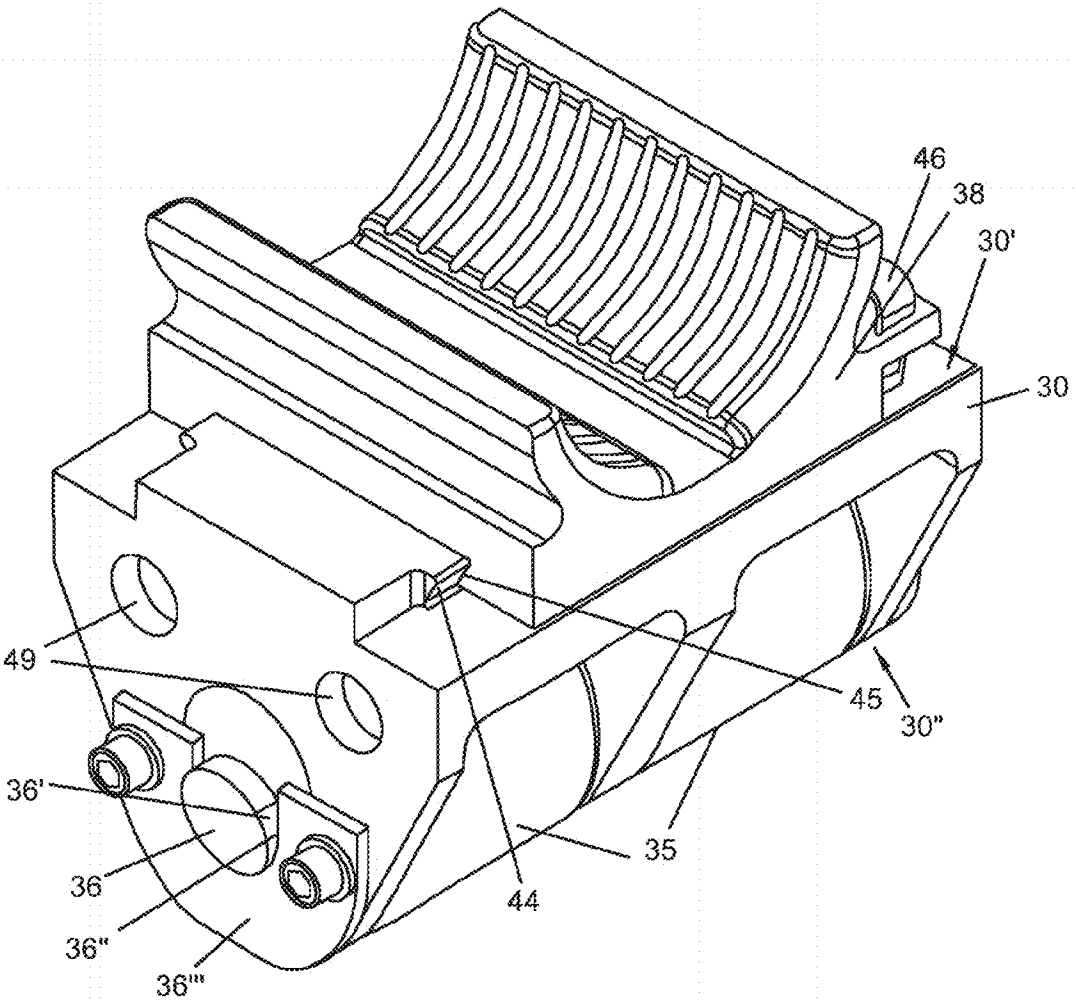
FIG. 10*a* is a perspective front view from one end of a conventional tubing gripper shoe installed on a novel gripper shoe carrier, according to the invention.
Figure 10B:
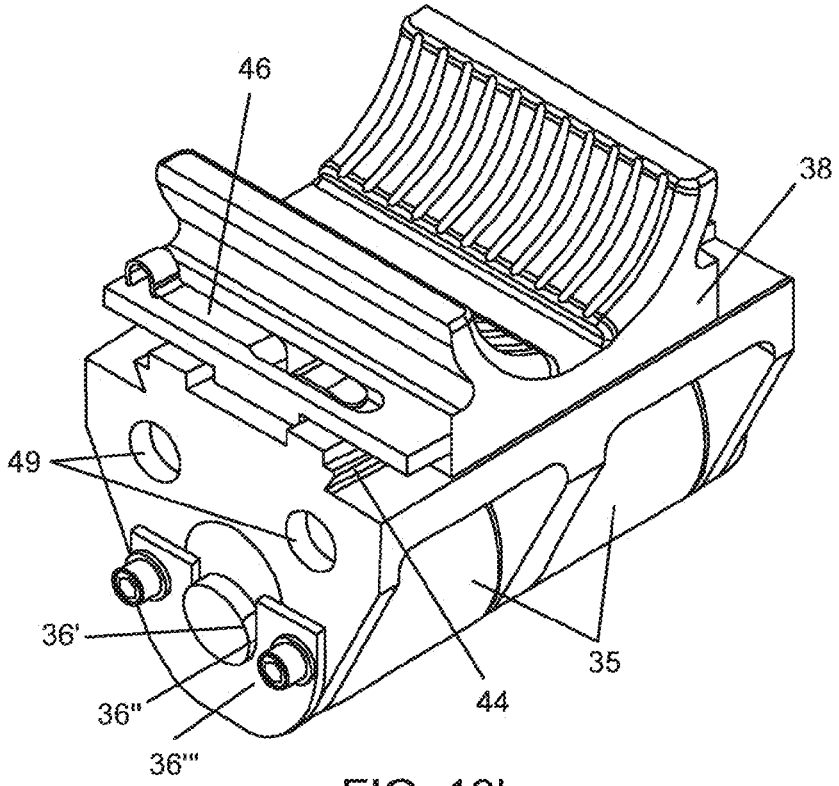
FIG. 10*b* is a perspective front view from another end of the conventional tubing gripper shoe installed on the novel gripper shoe carrier.
Figure 10C:
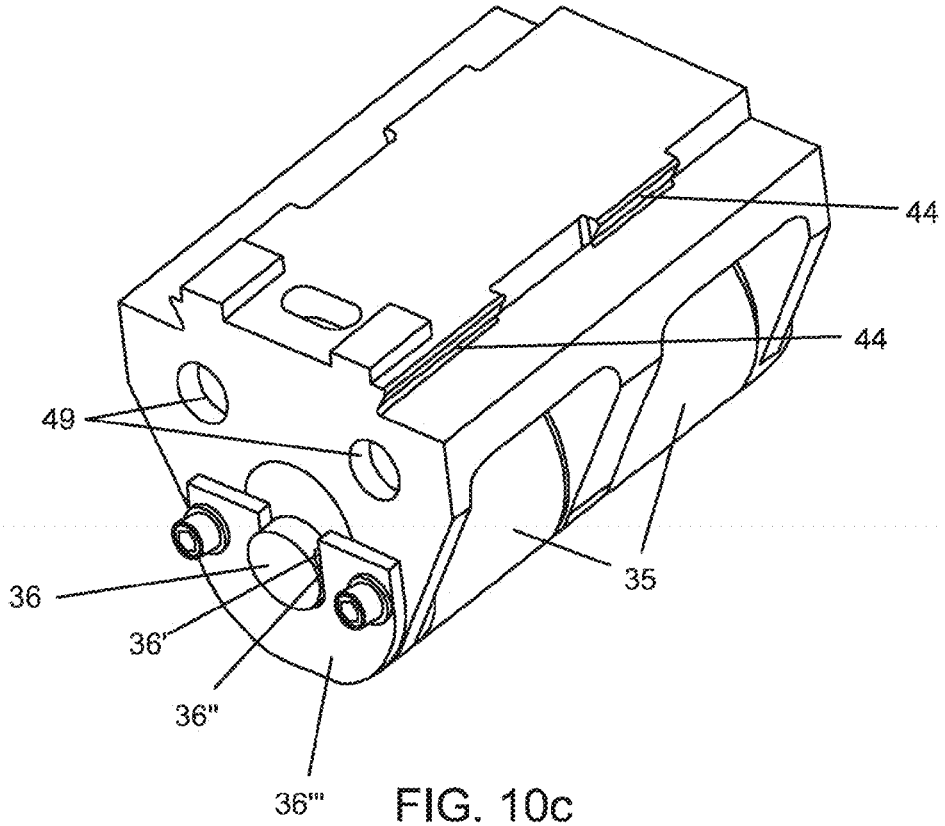
Figure 11:
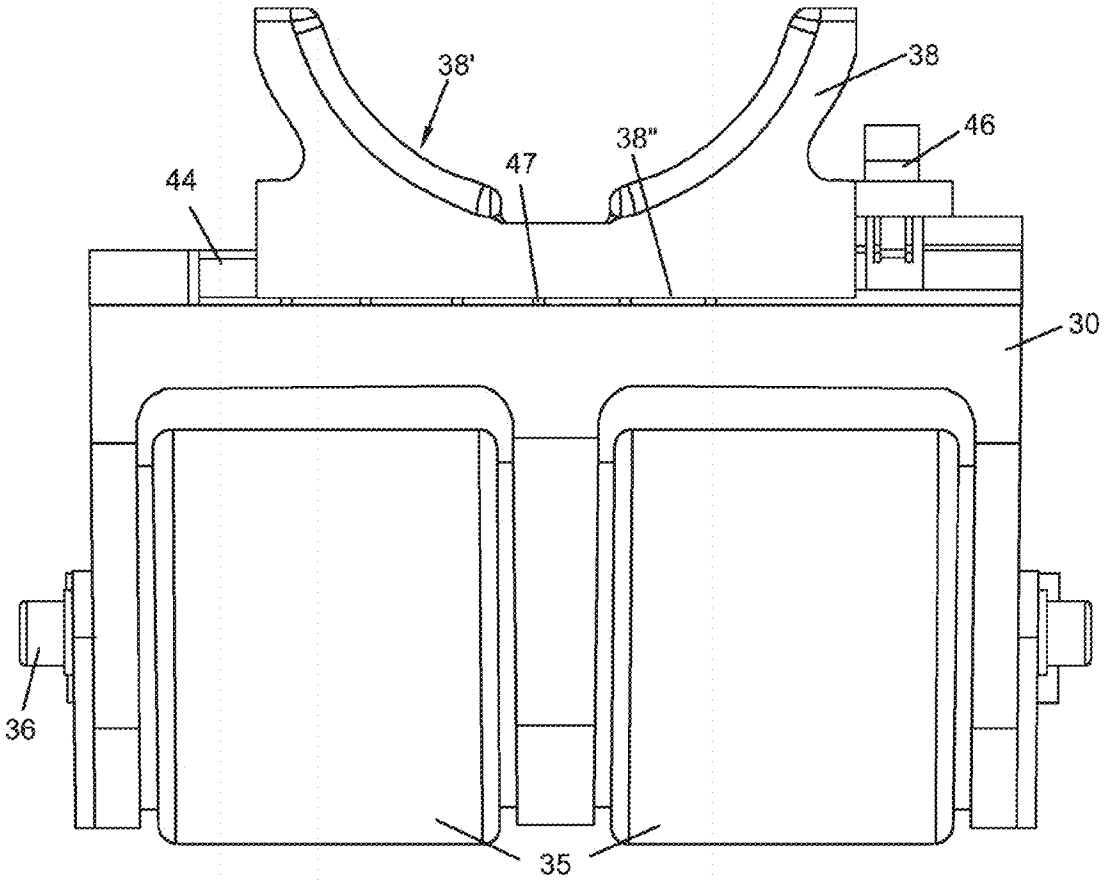
FIG. 11 is an end view of the view of FIG. 10.
Figure 12A:
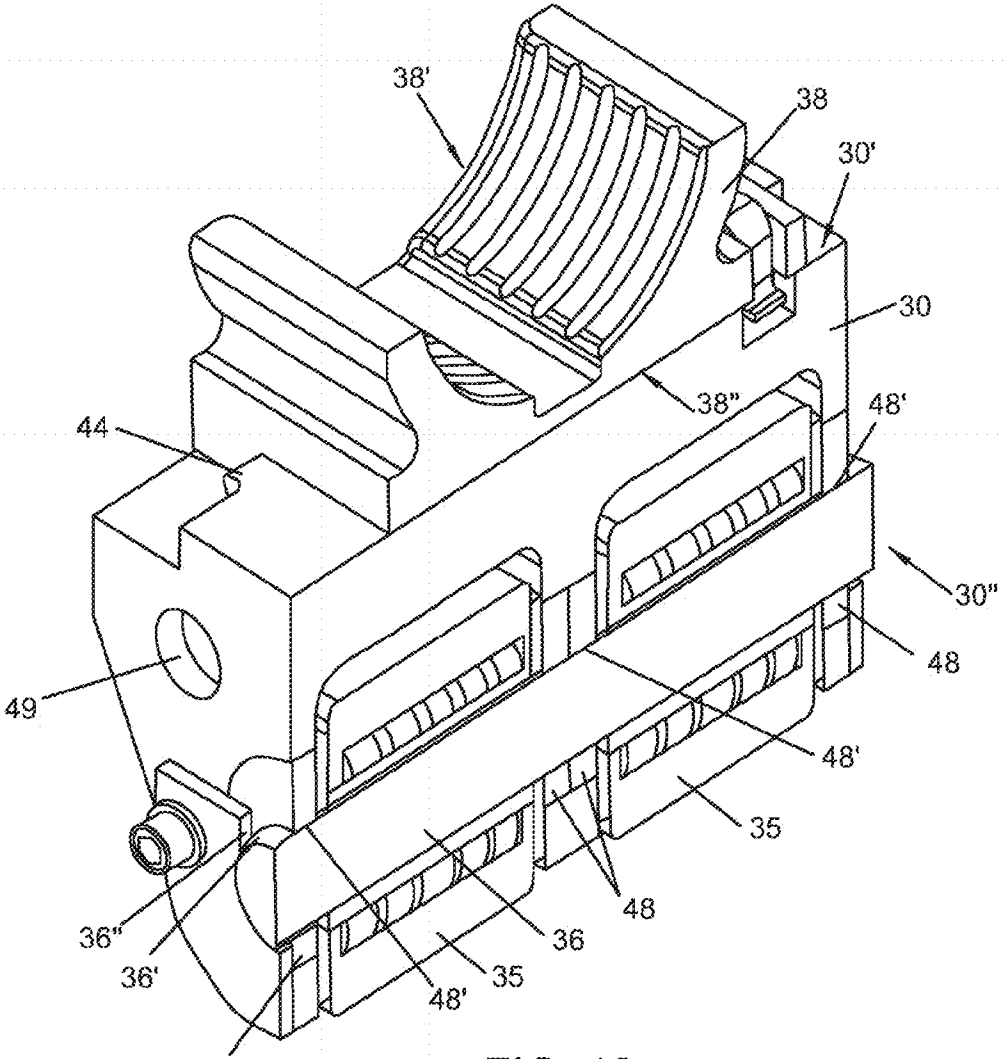
FIG. 12*a* is a vertical cross-section through the perspective view of FIG. 10.
Figure 13:
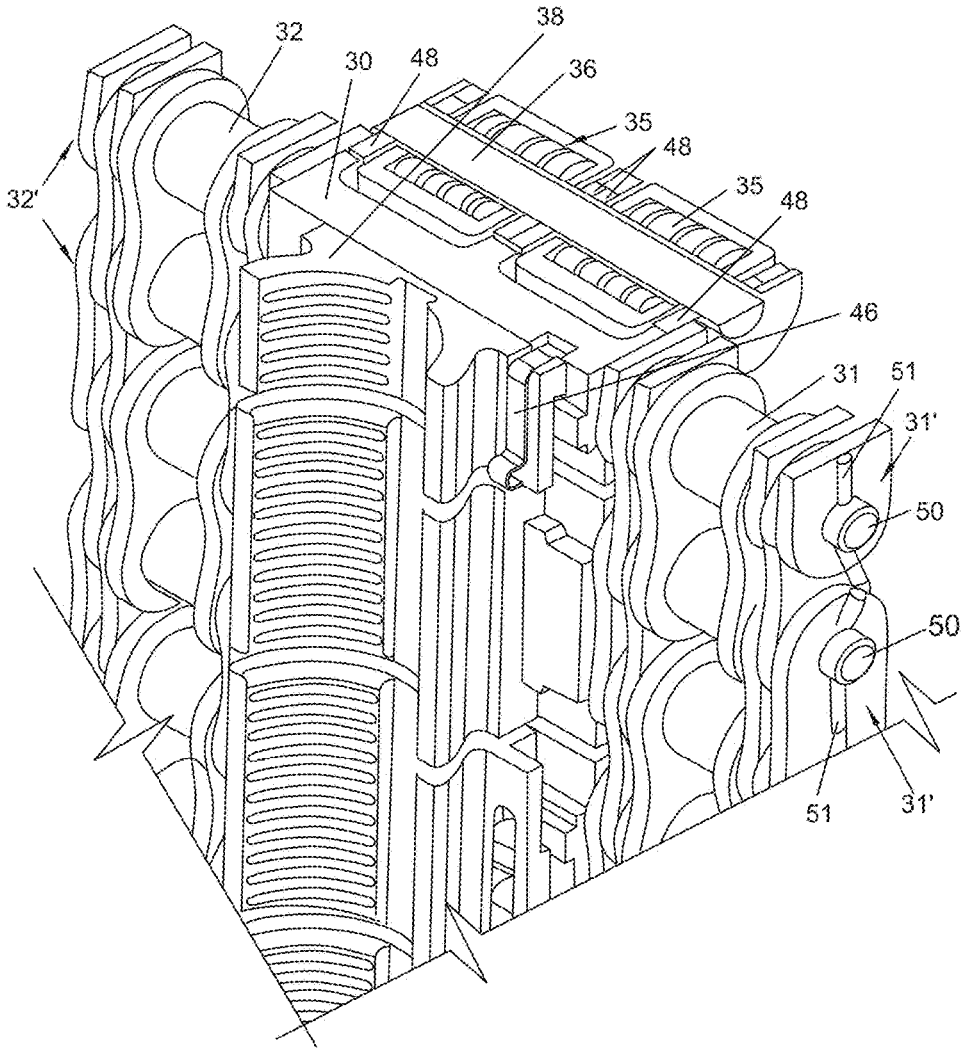
FIG. 13 is a perspective view of a plurality of gripper shoes and their novel shoe carriers interconnected by means of pairs of drive chains.

As shown on FIGS. 10-12 each carrier 30 has a front side 30' and a rear side 30".

The rear side 30" of the carrier 30 has roller means 35 configured roll about a shaft 36 attached to the carrier 30 against an elongate counter-force member 37 associated with the frame 21 and extending between said drive sprockets 33; 34.

The provision of the member 37 is to make sure that a gripping shoe 38 attached to the carrier 30 sufficiently engages the tubing 7 when it is forcibly driven through the injector head or apparatus 7. Suitably, the member 37 is position adjustable transversely of its longitudinal direction, so as to be adaptable to various diameters of tubing 7 and associated gripper shoes 38. As clearly shown on FIGS. 8 and 9 there is a pair of such members 37 to operate with the respective belt 28; 29.

Suitably, the sprockets 33 have internally a powerful torque creating motor, as symbolically indicated by reference 39. The motor 39 is suitably a hydraulic motor, but could just as well be an electric or pneumatic motor. It is instead possible to have each motor located externally of the sprockets 33 protruding out through the cage 5, as more clearly seen from viewing FIG. 4. In this latter case, an add-on cage, as shown on FIG. 4*b* should be provided to protect the motors and their accessories from damage in case of the cage 5 colliding with strange objects.

In order to adjust the transverse position of both counter-force members 37, i.e. the so-called "skates" and their mutual distance, there is provided a plurality of adjustment means, each such means having: at least one actuator 41, such as e.g a hydraulic cylinder or ram, a pair of customized, elongate rods 40, e.g. racks or rods with threads extending on either transverse side of the belts 28; 29 and powered by the at least one actuator 41 with a sleeve 41', the rods 40 co-acting with nuts 42; 43 attached to the respective member 37, yielding that turning the rod 40 in one direction causes the two members 37 to move apart, and turning the rod 40 in opposite direction causes the members 37 to have their interspace reduced. See FIG. 6 where there is used a total of eight hydraulic actuators in the operational example.

In an optional embodiment, the sprockets 33; 34 may be co-operative with the counter-force members 37 by being attached to an upper and lower end thereof, respectively, so as to be movable with the members 37 when interspace adjustment between the upper pair of sprockets 33 and between the lower pair of sprockets 34 is also required to adapt to a change in diameter of tubing to be conveyed and associated replacement of gripper shoes 38 to fit such diameter change.

Co-acting male means 44 and female means 45 of e.g. dove-tail configuration are provided for removably attaching a tubing gripper shoe 38 to each carrier 30 at the front side 30' thereof. As shown on FIG. 10*c*, the means 44 may not necessarily extend over the full face of the top side of the carrier 30 and correspondingly with the means 45 not over the full rear side (not shown) of the gripper shoe 38, but instead just over a part thereof, so that the shoe 38 can be dropped onto the front face of the carrier 30, and then just shifted a little in the direction of the means to cause mating engagement. Such co-acting means 44, 45 are well known in the art, as well as a locking spring 46 to interlock the shoe 38 and the carrier 30, thereby preventing the shoe 38 from sliding along the male means 44 when in operational use with its front side 38' facing the continuous tubing 7.

Although a shoe 38 normally is removably attached to the carrier 30, it is conceivable to have the shoe and carrier as a single unit.

It should be noted that a prior art elastomeric pad between a rear side 38" of the shoe 38 and a front side 30' of the carrier 30 is not used. However, in order to provide some interspace means instead of the prior art pad, e.g. the rear side 38' of the shoe 38 or the front side 30' of the carrier 30, transversely of the longitudinal direction of said dovetail shaped attachment means 44 and 45, could have a limited number of small knobs 47 (see FIG. 11).

However, in order to retain a limited amount of resilience of the shoe 38 acting upon the tubing 7, the shaft 36 of the roller means 35 is resiliently supported transversely of its longitudinal axis by means of a plurality of resilient members 48 fitted onto or about the shaft at spaced apart locations in the rear side 30" of the carrier 30. Such resilient members may be configured as conventional springs or customized metal springs or be made of resilient material, such as e.g. rubber, elastomeric material, or material having property of resiliency. Any such members will operate within their range of elasticity.

In order to prevent the shaft 36 from turning with the roller means, the shaft 36 is at either end provided with a pair of recesses 36' spanning over an angle e.g. 60°-120°, suitably 90-110° which engage the legs 36" of a U-shaped recess on a shaft bracket 36'" which is attached to the carrier 30 as shown on FIGS. 10 and 12. As shown on FIG. 12, the roller means 35 have incorporated therein roller bearings 35', suitably of a ball bearing type, in order rotate freely on the shaft 35, as rotation of the shaft 35 in the fitting holes 48' of the members 48 could cause these holes to become wider and adversely affect the resilience provided by the members 48.

Upon loading of the shoe 38 and carrier 30, the shaft 36 will tend to move towards the shoe 38 with its recesses 36' along the U-shaped legs 36" and against the resilient force created by the members 48.

As noted from FIG. 12*a*, and FIGS. 12*b*-12*k*, each member 48 may exhibit one or more of selectable configurations, e.g. one of: circular, ring-shaped, oval, elliptical, almost triangular, oblong with curved ends, and polygonal.

It is noted that on FIGS. 12*b*-12*k* the hole 48' could be located eccentrically or off-center or in the center of the member 48.

More specifically, FIGS. 12*b* and 12*c* show an annular member 48 with a center-located hole 48'. This embodiment is suitable in cases where the member is e.g. of heavy-duty elastomeric material. In other cases, it may be required to have more material "height" or amount of material between the hole 48' and an end of the member 48 closest to the shoe 38 than at the other diametrical side of the hole, in order to let the shoe and carrier combination be more resilient in order to adapt better to structural and dimensional variations of the tubing (or CED) and any wavy configuration of the counter-force member (the skate) or when using a member 48 of a material necessitating such more material to yield required resiliency. FIGS. 12*d*, 12*e*; 12*f*, 12*g*; 12*j*, 12*k* are typical examples in this respect.

The embodiment of FIGS. 12*d* and 12*e* as well as the embodiment of FIGS. 12*j* and 12*k* show an oblong or elliptical member 48 with curved ends and having its hole 48' off-center or located eccentrically. It is noted on FIGS. 12*j* and 12*k* that there are provided a plurality of slits 48", implying that the member 48 could conveniently be made of a suitable metal or HD plastic material, the zig-zag configured slits providing a spring feature.

The embodiment of FIGS. 12*f* and 12*g* is of polygonal, suitably rectangular shape with the hole 48' located off-center.

The embodiment of FIGS. 12*h* and 12*i* has a kind of triangular or truncated wedge shape with the hole 48' located slightly off-center. The wider end thereof will upon compression in a wedge shaped recess in the carrier 30 contribute to increased rigidity of the member 48, while minimizing its body "height" or amount of member material between the hole and the region thereof closest to the shoe. FIG. 12*l* indicates symbolically that in essence, the member 48 could be of any configuration and of any resilient spring configuration, even of a coiled spring or disc spring configuration.

The shaft 36 is configured to be fitted in the hole 48' of the resilient member 48. Further, the members 48 are each fitted into holes or cavities in the rear side 30' of the carrier 30 adjacent the longitudinal ends of the roller means 35.

It will be noted that the carrier 30 has two holes 49 extending through the carrier transversely of its direction of movement, i.e. transversely of the movement direction of the belts 28; 29. Rods 50 extend through these holes 49 and constitute pivot and connection pins at each joint of the chains 31; 32, and are prevented from sliding out of the holes 49 and the respective chain joints 31'; 32' by using locking wire or a U-clip 51 interacting with a hole or recess at a respective end region of the rod 50, as clearly illustrated on FIG. 13.

If a conventional type of carrier is used, i.e. with no resilience members 48 associated with the shaft 36 of the roller means 35, a novel and inventive tubing gripper shoe 52 could be used, as will now be explained with reference to FIGS. 14-20. However, such shoe could of course be used with the type of carrier just described, i.e. a carrier 30 having a plurality of resilience members 48 associated with the support of the shaft 36 of the roller means 35.

This novel tubing gripper shoe 52 comprises, according to the invention a gripper shoe base 53 having at a front 53' thereof longitudinal first and second edge regions 53", 53'". A first leg 54 and a second leg 55 extend at one end 54'; 55' thereof from said first and second edge regions 53"; 53'", respectively, said legs 54; 55 being inclined towards each other. Further, first and second tubing gripper members 56; 57 are located at the other end 54"; 55" of said first and second legs 54; 55.

The gripping members 56; 57 as well as the first and second legs 54; 55 extend parallel to movement direction of the belts 28; 29 along a full length of the shoe 52 and its base 53. The legs thereby exhibit elasticity or resiliency as regards bending transversely of the belt movement direction, but are rigid as regards shear forces, which appear substantially in the belt movement direction.

Figure 14:
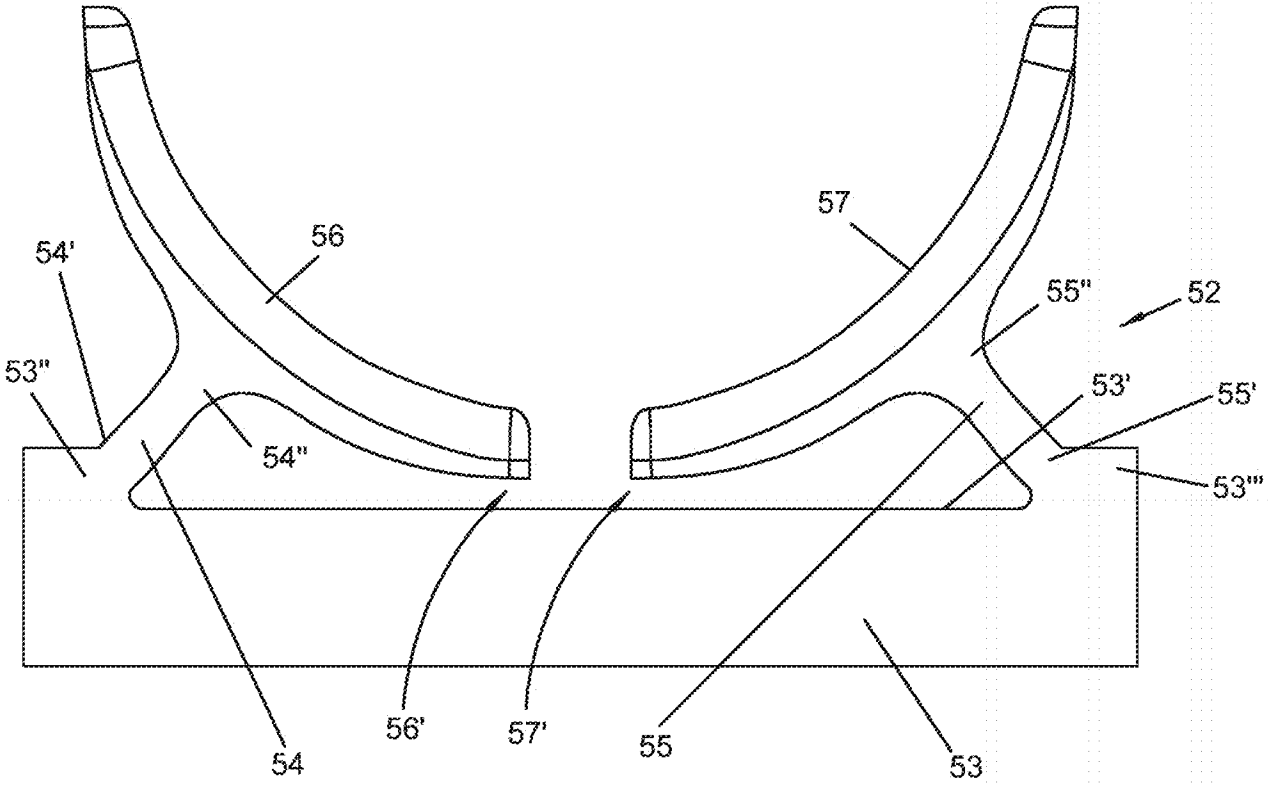
FIG. 14 is an end view of a tubing gripper shoe, according to the invention.
Figure 15:
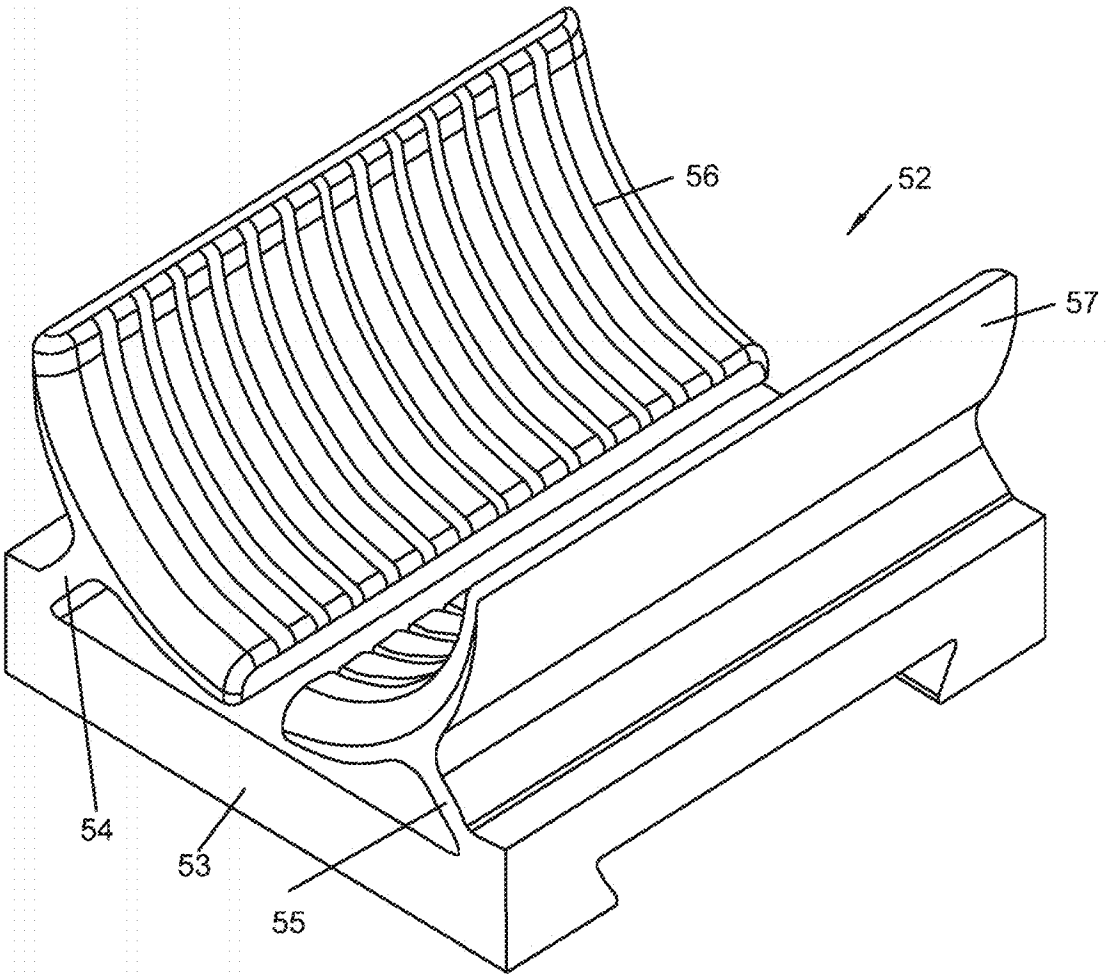
FIG. 15 is a perspective front view and from one end of the gripper shoe, according to the invention.
Figure 16:
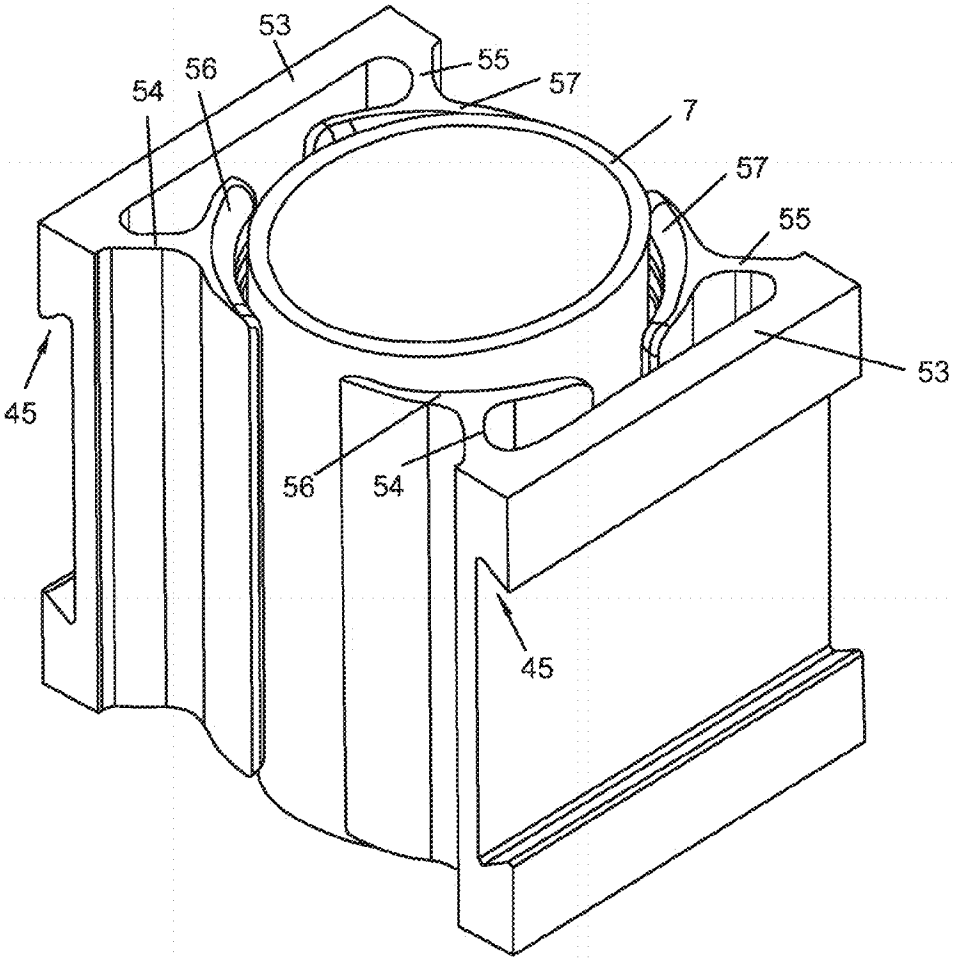
FIG. 16 is a perspective view from above of a co-operating pair of the gripper shoe gripping a section of a continuous tubing.

As indicated on FIG. 14 there are spaces 56'; 57' between the gripping members 56; 57 and the shoe base 53, respectively, said spaces acting as tilt limiters for the gripping members 56; 57.

The gripper shoe base 53, said first and second legs 54; 55 and said first and second tubing gripper members 56;57 are integrally made from a metal or metal alloy.

The first and second tubing gripper members 56; 57 are tiltable sideways upon engagement with the tubing 7 by virtue of resilience properties of the legs 54; 55.

In a practical, though non-limiting embodiment of the invention, the smallest wall thickness of said legs is in the range 0.3-1.5 cm.

Further, as a general rule, the radius of curvature of the tubing gripper shoe members 56: 57 should be adapted to the curvature of a circular circumference of the tubing, i. e. the diameter of the tubing. This diameter could be e.g. the maximum diameter as mentioned in connection with the ballooning phenomenon.

The gripper shoe 52 is suitably fitted onto a carrier; either a conventional carrier or the carrier 30 by means of conventional dovetail configured attachment means 44; 45 and locking means 46 as previously described.

Figure 17:
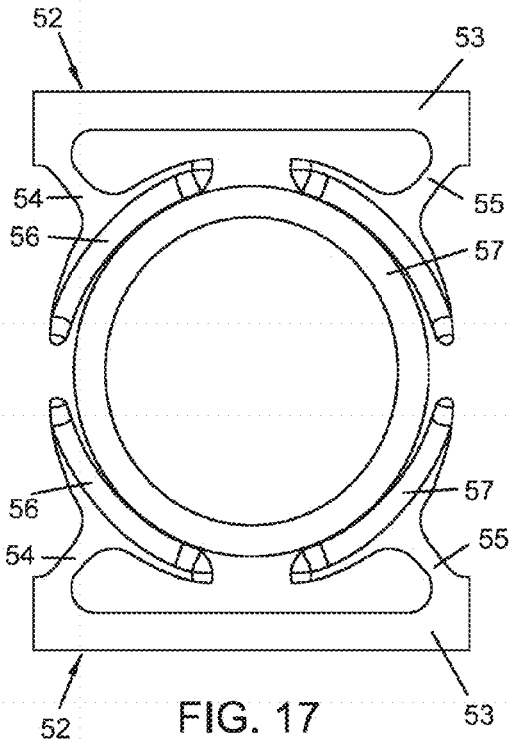
FIG. 17 is a view from above of a pair of the gripper shoes in engagement with a previously not used continuous tubing.

As shown on FIG. 17 the pair of gripper shoes 52 adequately engage the tubing 7 with the gripper shoe member 56; 57, the tubing 7 being new and therefore substantially circular. However, when a tubing is re-coiled to thereby be subsequently re-used, its cross-section may change into an oval configuration, as shown on FIGS. 18 and 19, or its diameter may increase as shown on FIG. 20, although the "ballooning" phenomenon shown on FIG. 20 may exhibit a circular configuration.

Figure 18:
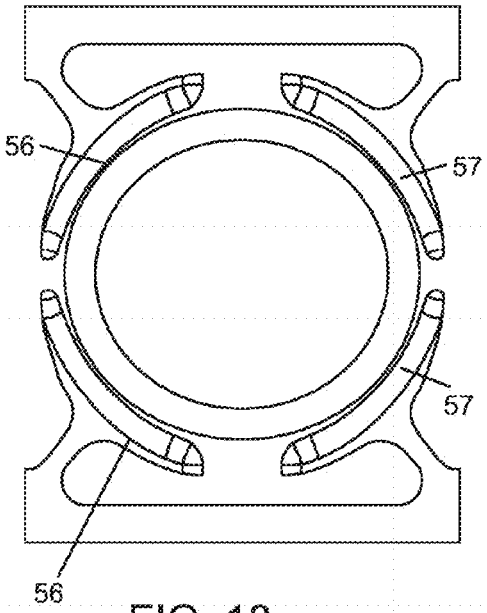
FIG. 18 is a view from above of a pair of the gripper shoes in engagement with a previously used continuous tubing having a maximum ovality in the x-direction.

On FIG. 18, the x-diameter is at its maximum. However, due to the resilience properties of the legs 54; 55 and the location of the members 56; 57, when the shoes 52 impose pressure on the oval tubing 7, the members 56; 57 will attempt to exert a pressure in the x-direction, thereby attempting to let the tubing 7 regain as far as possible its circular configuration, while providing adequate gripping engagement between the members 56; 57 and the tubing 7.

Figure 19:
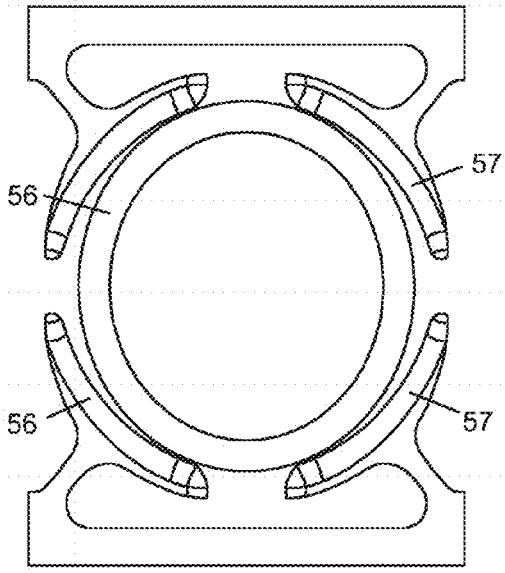
FIG. 19 is a view from above of a pair of the gripper shoes in engagement with a previously used continuous tubing having a maximum ovality in the y-direction.
Figure 20:
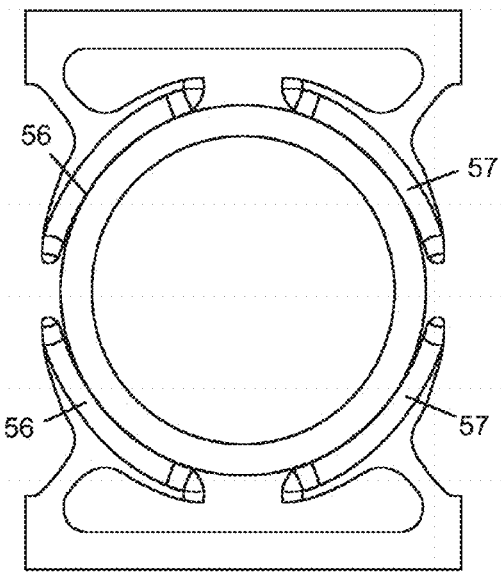
FIG. 20 is a view from above of a pair of the gripper shoes in engagement with a previously used continuous tubing having a maximum diameter in the x and y directions due to so-called ballooning.

On FIG. 19, the y-diameter is at its maximum. However, due to the resilience properties of the legs 54; 55 and the location of the members 56; 57, when the shoes 52 impose pressure on the oval tubing 7, the members 56; 57 will attempt to exert an extra pressure in the y-direction, thereby attempting to let the tubing 7 regain as far as possible its circular configuration, while providing adequate gripping engagement between the members 56; 57 and the tubing 7.

As will be appreciated, the phenomenon of "ballooning" is not created in the conveyor apparatus. On FIG. 20 it is noted that the gripper shoe members 56; 57 perfectly engage most of the circumference of the ballooned tubing 7, thereby in the process of exerting gripping pressure onto the tubing simultaneously adapting to ovality or ballooned state of the tubing 7, thereby preventing the tubing 7 from adversely changing its ovality or ballooned configuration.

As indicated in the introduction, there is an increased risk of causing unwanted bends or dents on the tubing due to varying feed-in or feed-out speeds and/or force conditions of the tubing to or from the conveyor apparatus. This is in particular challenge in the stabbing operation when the winch 12 is used, but could also happen when during normal conveyor operation there is excessive drag in the opposite direction of the feeding, a drag, which could even, be several tons.

According to the invention, this is solved in that the apparatus frame 21 at a lower end 21' thereof is tiltably connected to the apparatus cage 5 so as to cause said cage 5 and frame 21 to be mutually tiltable about a single tilting axis 58 being related to a pair of tilting joints 58'; 58" as shown on FIGS. 2-4, 6 and 7. Further, it is noted that the frame 21 at an upper end 21" thereof in a tilting plane is linked to two spaced apart upper regions 5"; 5'" of the cage 5 via resilient members 59; 60. The resilient members 59; 60 are suitable heavy duty springs, capable of withstanding heavy loading thereon, even in a range of tons. However, in certain cases said resilient members 59; 60 may not be required due to overall rigidity exhibited by the operationally co-operative structural parts, as well as the continuous elongate device 7.

The cage 5 is suitably rigidly attachable to an uppermost region of the lubricator strings 8 via the previously mentioned connector 22.

The frame 21 is tiltable about the axis 58 relative to the cage 5 in one direction or the other by a tilting angle not greater than 10 degrees. In most cases, a sufficient tilting angle is not greater than 3.0 degrees. In yet another, currently preferred mode, the tilting angle is not greater than 1.5 degrees. Associated with the connector 22 there is also a stuffing box 22' through which the tubing 7 passes. The tilting axis 58 passes through both of the tilting joints 58'; 58" as well as the stuffing box 22' located between these tilting joints.

Figure 6A:
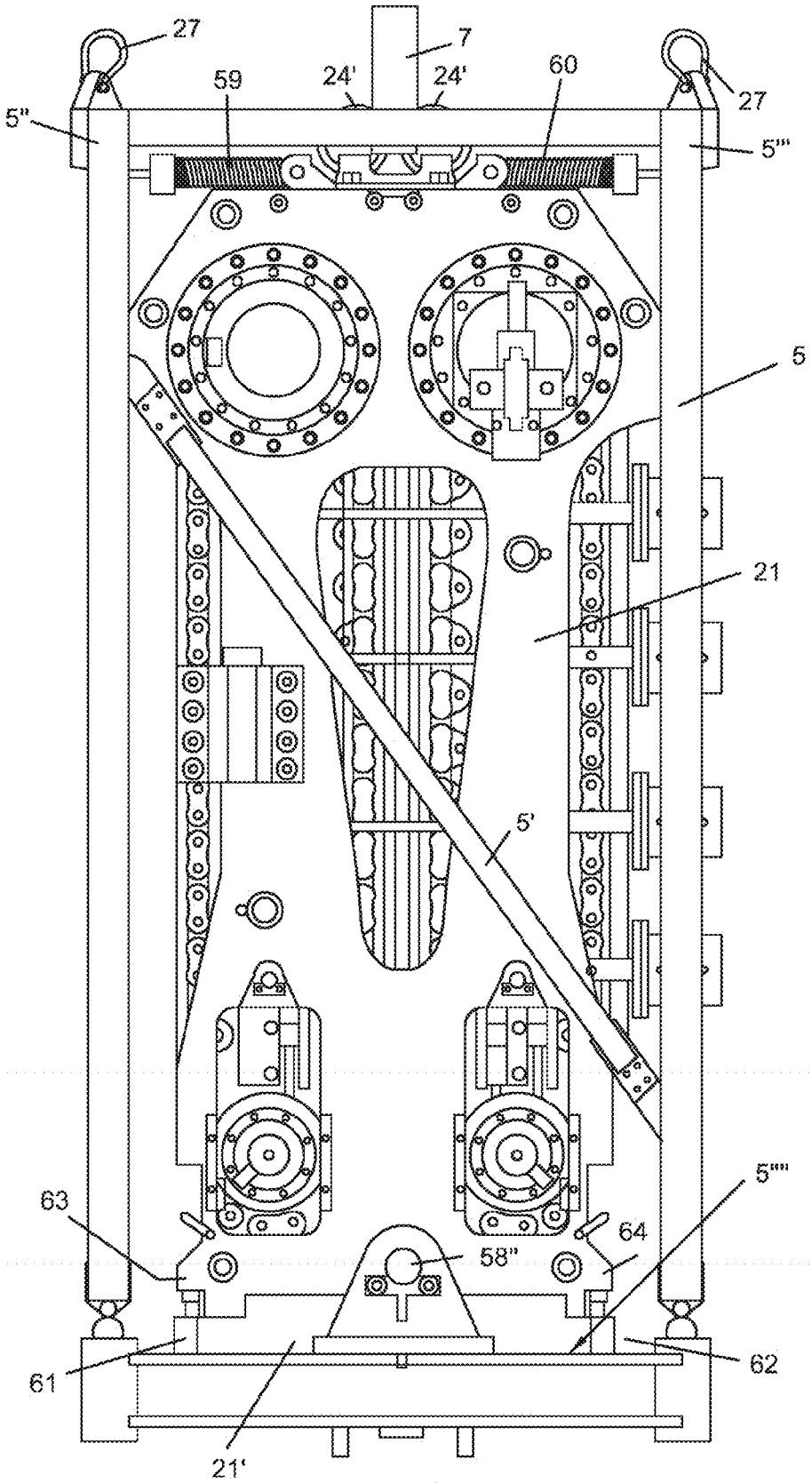
FIG. 6*a* is an enlarged view of the apparatus from the other side.
Figure 6B:
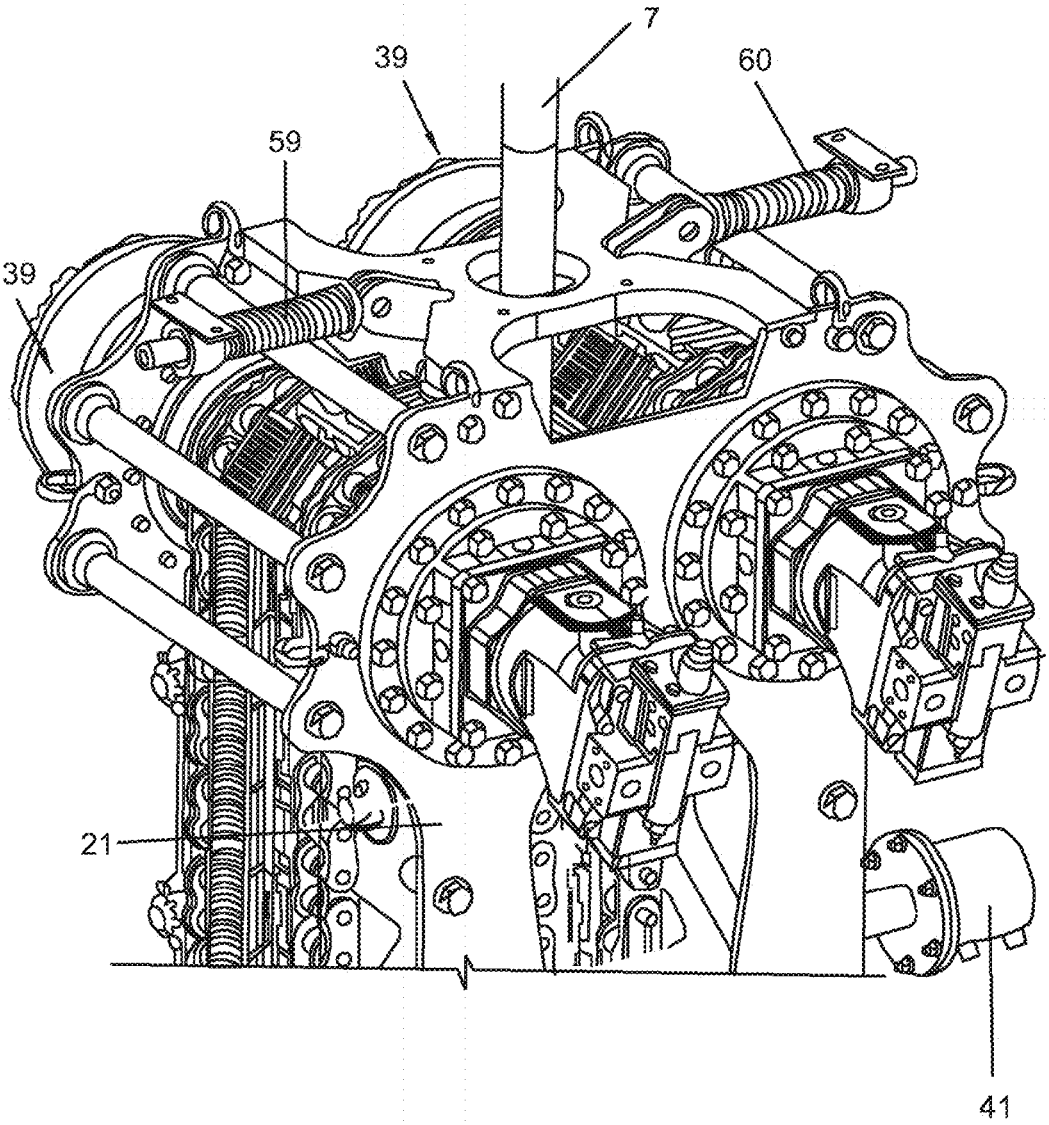
FIG. 6*b* is detailed top region, perspective view from above of the apparatus frame and its operational elements thereof, seen from said other side.

As indicated on FIG. 6, at a lower region 5"" of the cage 5 there are setting means 61; 62 interacting with engaging means 63; 64 on a lower region 21' of the frame 21 for adjustably setting maximum tilting angles.

The cage 5 can be tilted to ensure alignment of the injector with a well center, and the springs 59; 60 further enable the frame 21 to be aligned with the well.

In the description to follow, there is described improvements of the skate or counter-force member of the conveyor apparatus, with reference to FIGS. 8, 9 and 21-24.

As indicated, a conventional skate or counter-force member is very easily subjected to deformations along its length, causing the skate 37 to exhibit along its length a wavy shape.

In order to overcome these drawbacks of the prior art, the counter-force member 37 has an elongate part 37', and b) along the length of the elongate part 37' a plurality of pairs of substantially V shaped elements 37", the elements of each pair extending with their V-legs 37'" laterally from oppositely located side edges of the elongate part towards an apex 37'''' of the V-shaped element.

An axis 61 of one leg 37''' of a V-element of one pair of elements, at one side edge of the elongate part, is aligned with an axis 62 of a leg 37''' of a V-element of another and adjacent pair of elements, at the other side edge of the elongate part 37'. The V-elements 37'' are integral with the elongate part 37' and co-planar therewith.

The elongate part 37' and each of said elements 37'' have substantially the same thickness.

In order to strengthen a mid-region of the skate 37, at least one pair of the V-shaped elements have legs 37''' which are wider than the legs 37''' of other pairs of V-shaped elements. Thus, said at least one pair of V-shaped elements 37'' is located at longitudinal mid-region side of the elongate part. As shown on FIGS. 22 and 24, at least two pairs 63, 64 of the V-shaped elements 37'' have legs 37''' which are wider than the legs 37''' of other pairs of V-shaped elements. Thereby, one pair 63 of the at least two pairs of V-shaped elements 37'' is located upstream of longitudinal mid-region sides of the elongate part 37', and wherein another pair 64 of the at least two pairs of V-shaped elements 37'' is located downstream of longitudinal mid-region sides of the elongate part.

Figure 21:
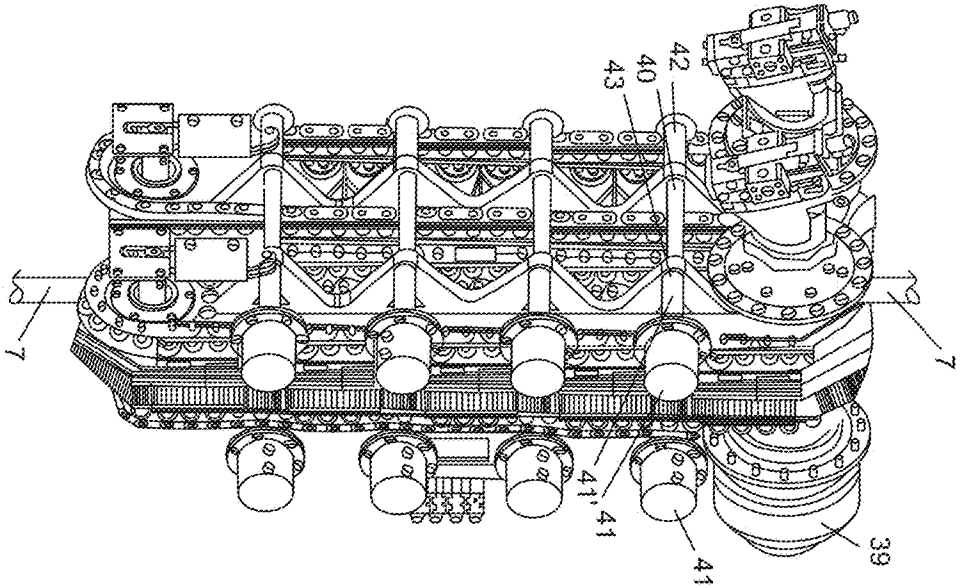
FIG. 21 is a perspective view of the conveyor apparatus shown without apparatus frame and cage, and with a pair of counter-force members, according to the invention.
Figure 22:
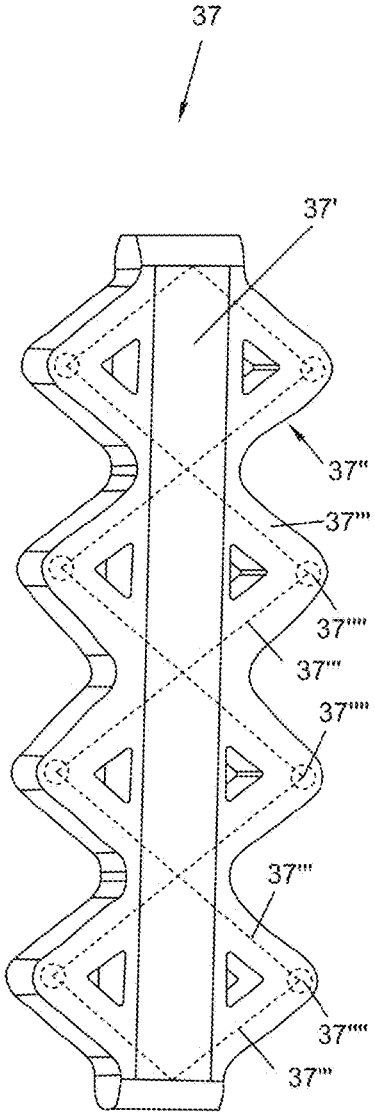
FIG. 22 is a perspective view of the counter-force member.
Figure 23:
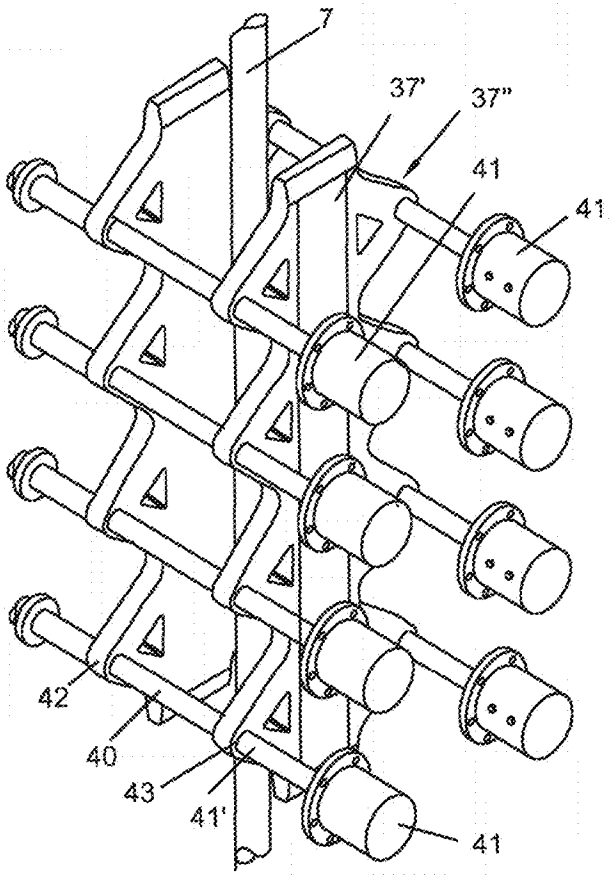
FIG. 23 is a perspective view of a pair of counter-force members in interaction with means to adjust mutual space between the members.

From viewing FIGS. 21 and 23, it is noted that the previously described means 40, 41, 41', 42, 43 to adjust mutual spacing of the pair of counter-force members 37 interact with the V-apexes 37'''' of said elements 37''.

By the arrangement of the elements 37'' as shown and described, it will be noted that the axes 61, 62 cross at a centerline of the part 37', thereby creating a structure which has crisscross load distribution, rather than specific load locations having high stress, i.e. a kind of structural beam.

Figure 24:
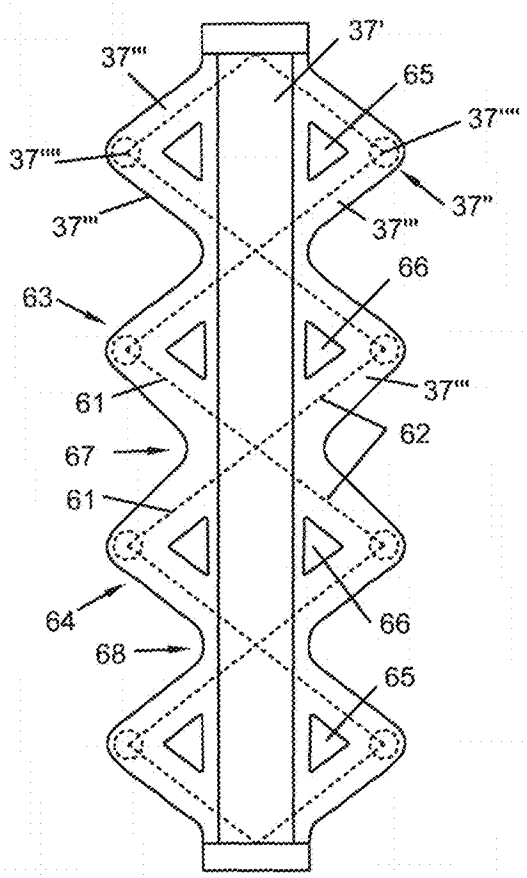
FIG. 24 is a plan view of the counter-force member.

Contrary to the prior art, from FIG. 24, it is noted that the axes 61, 62 or centerlines of the legs 37''' do not cross the elongate part 37' at right angles, but at an angle suitably in the range 20°-70°, dependent on the angle at the apex 37'''' and the number of pairs of elements 37'' provided.

By having such V-shaped elements 37'', there is between the elongate part 37' and the elements 37'' created triangular cutouts, such as cutouts 65, 66. In the embodiment shown on FIGS. 22 and 24, the triangular cutout 65 is slightly smaller than the cutout 66, and it is noted that the distance from the elongate part 37' to the "valley" 67 is somewhat greater than the distance from the valley 68, thus yielding extra strength at the mid-region of the counter-force member 37 or skate. The triangular "cut-outs" contribute to the "structural beam" configuration, thereby yielding improved overall force-vectors.

Figure 25:
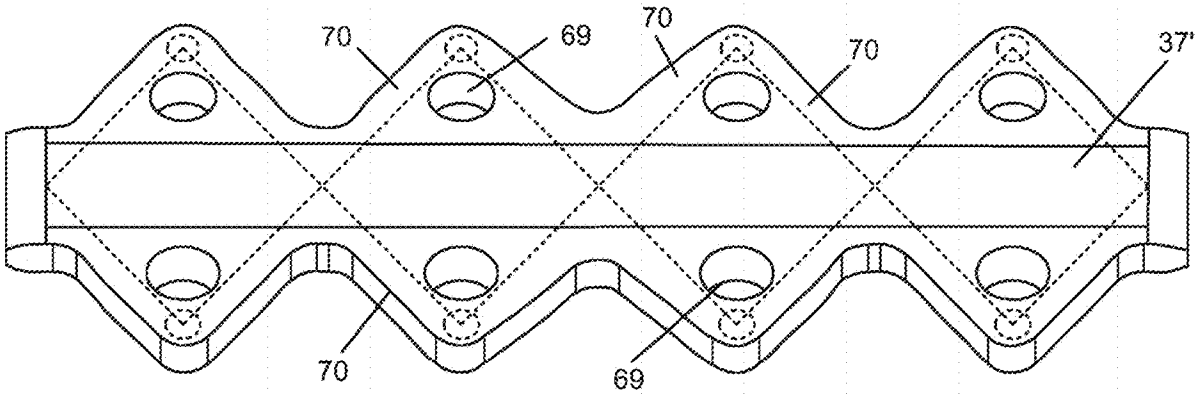
FIG. 25 is a perspective view of a slightly modified counter-force member.
Figure 26:
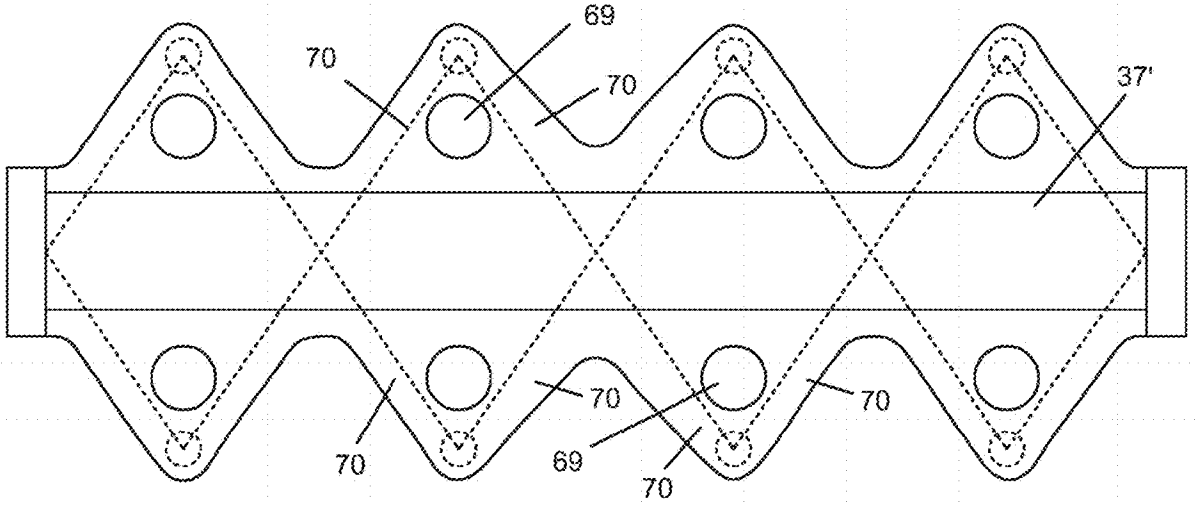
FIG. 26 is a plan view of the counter-force member of FIG. 25.

From FIGS. 25 and 26, it is noted that the triangular cutouts 65, 66 seen on FIG. 24 have been replaced by circular cutouts 69 and associated legs 70. Such a configuration may affect force vector direction not to be as rectilinear as in the embodiment having triangular cutouts 65, 66 and more distinct legs 61, 62. However, circular cutout may yield less structural stresses at the cutout region.

Thus, there is provided a uniform depression of the skate or counter-force member 37 by the rollers over substantially its entire length.

Hence, from the description hereinbefore it would be clear that all the objects of the invention are achieved.

The present invention has been described with reference to preferred embodiments and aspects thereof and related to the accompanying drawings for the sake of understanding only and it should be obvious to persons skilled in the art that the present invention includes all legitimate modifications within the ambit of what has been described hereinbefore and claimed in the attached claims.

The invention claimed is:

1. A conveyor apparatus to enable feeding of continuous elongate device along a feeding axis down through the conveyor apparatus, to enable insertion of tools through a wellhead and a well below or up through the conveyor apparatus by pulling action enabling retrieval of a tool from the wellhead and the well below, the conveyor apparatus comprising:

an apparatus cage, an apparatus frame within the apparatus cage, a guide arch for guiding said continuous elongate device into said feeding axis, said guide arch being attached to said apparatus cage, and a pair of oppositely located, co-operatively movable, segmented continuous belts installed in the apparatus frame, each belt comprising a plurality of interconnected device gripper shoe carriers carried and movable via a pair of continuous belt drive chains running over respective pairs of chain drive sprockets, a device gripper shoe co-operative with each carrier to positively engage the continuous elongate device, and wherein the apparatus frame at a lower end thereof is tiltably connected to the apparatus cage so as to cause apparatus frame to be tiltable relative to said apparatus cage in a tilting plane about a single tilting axis, said single tilting axis crossing the feeding axis of the continuous elongate device.

2. The conveyor apparatus of claim 1, wherein the apparatus frame at an upper end thereof in the tilting plane is linked to two spaced apart upper regions of the apparatus cage via resilient members.

3. The conveyor apparatus of claim 1, wherein the tilting plane is located transversely of a rotary axis of said chain drive sprockets.

4. The conveyor apparatus of claim 1, wherein a lubricator string is located between the conveyor apparatus and the wellhead.

5. The conveyor apparatus of claim 4, wherein a blowout preventer is located between the lubricator string and the wellhead.

6. The conveyor apparatus of claim 4, wherein the apparatus cage is rigidly attachable to an uppermost region of the lubricator string via a connector.

7. The conveyor apparatus of claim 1, wherein the apparatus frame is tiltable in said tilting plane relative to the apparatus cage in one direction or the other by a tilting angle not greater than 10 degrees.

8. The conveyor apparatus of claim 7, wherein the tilting angle is not greater than 3.0 degrees.

9. The conveyor apparatus of claim 7, wherein the tilting angle is not greater than 1.5 degrees.

10. The conveyor apparatus of claim 1, wherein at a lower region of the apparatus cage there are setting means interacting with engaging means on a lower region of the apparatus frame for setting maximum tilting angles.

11. The conveyor apparatus of claim 1, wherein the apparatus frame at a top region thereof has a pair of rollers between which the continuous elongate device passes, and wherein a force imposed on one or the other of the rollers causes tilting of the apparatus frame relative to the apparatus cage.

12. The conveyor apparatus of claim 1, wherein the continuous elongate device is selected from the group consisting of continuous tubing and coiled tubing.

* * * * *